US006667652B2

(12) United States Patent
Hosoki

(10) Patent No.: US 6,667,652 B2
(45) Date of Patent: Dec. 23, 2003

(54) STABILIZED POWER CIRCUIT

(75) Inventor: Mitsuru Hosoki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/977,360

(22) Filed: Oct. 16, 2001

(65) Prior Publication Data

US 2002/0050853 A1 May 2, 2002

(30) Foreign Application Priority Data

Oct. 27, 2000 (JP) ..... 2000-329594

(51) Int. Cl.[7] ..... G05F 1/10; G05F 3/02
(52) U.S. Cl. ..... 327/538; 327/540; 327/541
(58) Field of Search ..... 327/538, 540, 327/541, 478, 543, 427, 434, 435; 323/311, 312

(56) References Cited

U.S. PATENT DOCUMENTS 5,677,558 A * 10/1997 McGlinchey ..... 257/370
5,831,471 A * 11/1998 Nakajima et al. ..... 323/316
5,929,617 A * 7/1999 Brokaw ..... 323/280

FOREIGN PATENT DOCUMENTS

| | | |
|---|---|---|
| JP | 04218819 A | 8/1992 |
| JP | 05-036711 | 2/1993 |
| JP | 08-255028 | 10/1996 |

* cited by examiner

*Primary Examiner*—Tuan T. Lam
(74) *Attorney, Agent, or Firm*—Birch, Stewart, Kolasch & Birch, LLP

(57) ABSTRACT

When an output voltage detected by an output voltage detecting circuit is higher than the output voltage under normal operating condition, and lower than a predetermined value which was set to be not more than a value at which a current begins to flow from a collector to a base of a transistor, a dropper-type stabilized power circuit outputs a controlling signal which conducts a compensating resistance switch by a switch driving circuit. This makes a high-temperature-leak compensating resistance ready to function. While, when the voltage of an output terminal OUT rises to be not less than the predetermined value, a controlling signal which does not conduct the compensating resistance switch by the switch driving circuit is outputted so that the current does not flow to the high-temperature-leak compensating resistance.

20 Claims, 15 Drawing Sheets

STABILIZED POWER CIRCUIT

FIELD OF THE INVENTION

The present invention relates to a dropper-type stabilized power circuit, and specifically to a configuration which prevents a reverse current which flows from the output side to the input side in a low-saturation-type stabilized power circuit which utilizes a PNP-type transistor.

BACKGROUND OF THE INVENTION

FIG. 15 shows a basic structure of a low-saturation-type series regulator 51, one of dropper-type stabilized power circuits, which utilizes a PNP-type transistor as a power transistor.

An emitter of a power transistor 11 is connected to an input terminal IN of the series regulator 51. Further, a collector of the power transistor 11 is connected to an output OUT of the series regulator 51.

A collector of a driving transistor 12 made up of an NPN-type transistor is connected to a base of the power transistor 11. Further, an emitter of the driving transistor 12 is connected to a GND.

An output terminal of an error amplifier 13 is connected to a base of the driving transistor 12. Further, an inverting input terminal of the error amplifier 13 is connected to a junction of a voltage dividing resistance R1 and a voltage dividing resistance R2 which are provided in series between the output terminal OUT of the series regulator 51 and the GND.

A non-inverting input terminal of the error amplifier 13 is connected to a standard power circuit 14 which generates a reference voltage Vref1. Further, a power voltage Vcc of the error amplifier 13 and the standard power circuit 14 is taken from the input side of the series regulator 51. Further, a high-temperature-leak compensating resistance REB is provided between the emitter and the base of the power transistor 11.

In the foregoing structure, a feedback voltage corresponding to an output voltage Vo which exists from the junction of the voltage dividing resistances R1 and R2 to the series regulator 51 is inputted to the error amplifier 13. Further, the error amplifier 13 compares the feedback voltage with the reference voltage Vref1 of the standard power circuit 14 and outputs a voltage according to the gap between the feedback voltage and the reference voltage Vref1, so that the error amplifier 13 adjusts a collector current of the driving transistor 12, that is, a base current of the power transistor 11. This adjustment increases/decreases the collector current of the power transistor 11, so that the output voltage Vo is stabilized.

The high-temperature-leak compensating resistance REB increases the collector current of the power transistor 11 by increasing a leak current of the driving transistor 12 at high temperatures, so that a rise of the output voltage Vo is prevented.

However, in the conventional dropper-type stabilized power circuit such as the foregoing series regulator 51 which utilizes the high-temperature-leak compensating resistance REB, there is a case where a voltage higher than input voltage (Vin) is applied to the output (OUT) of the stabilized power circuit from outside due to a misconnection etc. In this case, a base current in a reverse direction flows from the output side via the collector of the power transistor (11), the base of the power transistor (11), and the high-temperature-leak compensating resistance REB to the input side. Thus, the power transistor (11) becomes ON in a reverse direction, so that there exists a problem that the reverse current flows from the output side to the input side.

Japanese Unexamined Patent Publication No. 36711/1993 (Tokukaihei 5-36711) (published date: Feb. 12, 1993) discloses a following stabilized power circuit. In the stabilized power circuit, a diode is provided in parallel with a power transistor so that an output side is an anode and an input side is a cathode. Thus, the reverse current flows to the diode, so that the power transistor is protected.

However, for example, in a portable device which utilizes a battery, there is a case where it is possible to obtain an output of the stabilized power circuit from a body via a connection terminal such as an option. In this case, there is a possibility that a voltage higher than an input voltage (Vin) can be applied to the output (OUT) of the stabilized power circuit due to a misconnection etc. In such a case, since input of the stabilized power circuit is supplied by a battery, the battery is charged by the reverse current. Further, there is a possibility that the battery may ignite due to overcharge, depending on cases. Thus, even when the series regulator 51 which is arranged to have the high-temperature-leak compensating resistance REB has a diode for a by-puss like the foregoing publication, this problem cannot be solved.

SUMMARY OF THE INVENTION

The object of the present invention is to provide a dropper-type stabilized power circuit which can prevent a reverse current which flows from an output side to an input side, even when a voltage of an output side is higher than voltage of an input side with a high-temperature-leak compensating resistance provided.

The dropper-type stabilized power circuit of the present invention, in order to achieve the foregoing object, includes a PNP-type transistor; a high-temperature-leak compensating resistance provided between an emitter and a base of the power transistor; a compensating resistance switch provided in series with the high-temperature-leak compensating resistance between the emitter and the base; an output terminal which outputs a voltage; an input terminal to which a voltage is inputted; and compensating resistance switch controlling means for detecting a voltage of the output terminal and conducting the compensating resistance switch under normal operating conditions in which an input voltage of the input terminal is dropped so as to obtain an output voltage of the output terminal, and not conducting the compensating resistance switch when the detected output voltage is higher than the output voltage under normal operating conditions and is not less than a predetermined value which is set to be not more than value at which a current begins to flow from a collector to the base of the power transistor.

According to the invention, under normal operating conditions in which the input voltage is dropped so as to obtain the output voltage, the compensating resistance switch controlling means conducts a compensating resistance switch provided in series with the high-temperature-leak compensating resistance between the emitter and the base of the power transistor, and makes the high-temperature-leak compensating resistance ready to function. On the other hand, when a voltage of the output terminal becomes higher than the output voltage under normal operating conditions due to miss-connection etc. and becomes higher than the predetermined value which was set to be not more than a value at which a current begins to flow from the collector to the base of the power transistor, the compensating resistance switch controlling means does not conduct the compensating resistance switch so that a current does not flow to the high-temperature-leak compensating resistance.

Thus, even when a voltage of the output terminal is not less than the value at which a current begins to flow from the collector to the emitter of the power transistor, there is no current which flows from the collector via the base of the power transistor to the high-temperature-leak compensating resistance. Further, when the output voltage becomes high in a dropper-type stabilized power circuit, a base current of the power transistor is restrained generally, so that a base current of the power transistor is controlled so as not to flow under abnormal operating conditions in which a voltage of the output terminal is higher than a voltage of the input terminal. Thus, under abnormal operating conditions, the current which flows from the collector via the base of the power transistor to the paths other than the high-temperature-leak compensating resistance is restrained. By this, it is possible to prevent the power transistor from being ON in a reverse direction.

As a result, it is possible to provide the dropper-type stabilized power circuit which can prevent the reverse current which flows from the output side to the input side, when voltage of the output side is higher than voltage of the input side with the high-temperature-leak compensating resistance provided, For a fuller understanding of the nature and advantages of the invention, reference should be made to the ensuing detailed description taken in conjunction with the accompanying drawings.

DESCRIPTION OF THE EMBODIMENTS

[First Embodiment]

Figure 1:
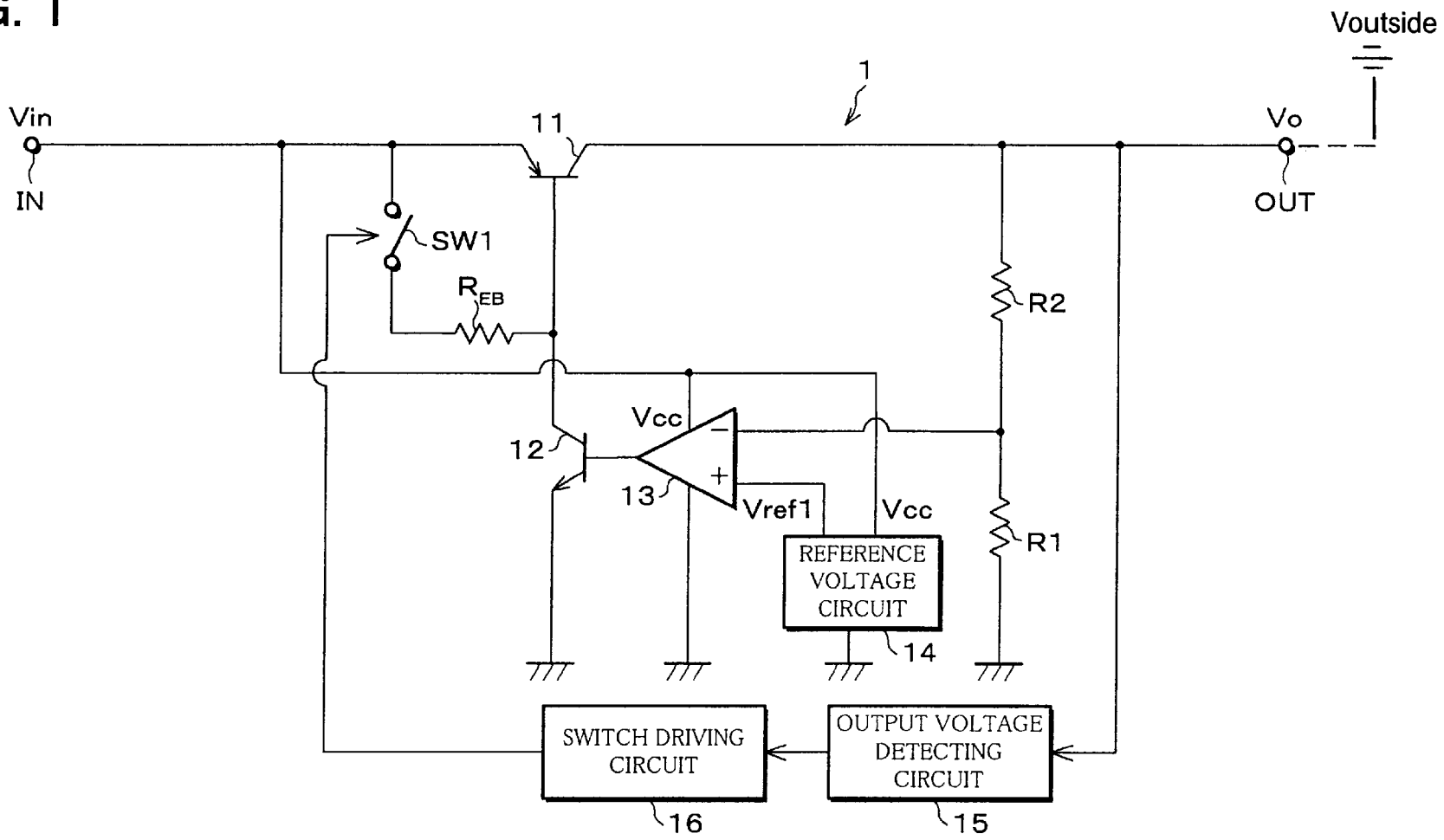
FIG. 1 is a circuit block diagram showing a structure of a stabilized power circuit according to the first embodiment of the present invention.

One embodiment which realizes a stabilized power circuit of the present invention is described by using FIG. 1 to FIG. 3 as follows. Note that, components which have the same functions as components described in the foregoing BACKGROUND OF THE INVENTION are given same reference numerals, and descriptions thereof are omitted.

FIG. 1 shows a structure of a series regulator 1 as a stabilized power circuit according to the present embodiment.

The series regulator 1 includes a power transistor 11, a driving transistor 12, an error amplifier 13, a reference voltage circuit 14, an output voltage detecting circuit 15, a switch driving circuit 16, voltage dividing resistances R1 and R2, a high-temperature-leak compensating resistance REB, and a compensating resistance switch SW1.

The compensating resistance switch SW1 is provided between an emitter and a base of the power transistor 11 in series with the high-temperature-leak compensating resistance REB. Further, when the compensating resistance switch SWI is conducted, it makes up a current path including the high-temperature-leak compensating resistance REB, and when the compensating resistance switch SW1 is not conducted, it separates the high-temperature-leak compensating resistance REB from an emitter/base line.

The output voltage detecting circuit 15 detects voltage of an output terminal OUT. Further, this output voltage detecting circuit 15 detects a stabilized output voltage Vo when the series regulator 1 which obtains the output voltage Vo by dropping an input voltage Vin under normal operating conditions. Further, when a voltage is applied to the output terminal OUT from outside, the output voltage detecting circuit 15 detects a total output voltage Vo including the applied voltage. Further, the detected result is inputted to a switch driving circuit 16.

The switch driving circuit 16 compares a voltage of predetermined value which was generated therein or given from outside with the output voltage Vo detected by the output voltage detecting circuit 15. Further, the switch driving circuit 16 outputs a controlling signal which opens or closes the compensating resistance switch SW1 according to whether the output voltage Vo is higher than the predetermined value or not. The predetermined value is used to judge whether or not the output voltage Vo has become higher than the value under normal operating conditions to approach to the state that the reverse current flows from an output side of the series regulator to an input side.

In a case where the compensating resistance switch SW1 is conducted, the reverse current begins to flow from the output side to the input side when the output voltage Vo is higher than the input voltage Vin by not less than the inverse voltage (about 0.7V) between the collector and the base in the power transistor 11.

Thus, the predetermined value which is higher/lower comparing standard of the output voltage Vo is set to be higher than the output voltage Vo under normal operating conditions (normal value), and is set to be not more than the output voltage Vo (normal value) +0.7 V which is exactly lower than the value at which the inverse current begins to flow. Further, when the predetermined value is set to be near the output voltage Vo (normal value), there is a fear that the high-temperature-leak compensating resistance REB is separated even under normal operating conditions due to the change of temperature of the output voltage Vo etc. Taking this into consideration, it is preferable that the predetermined value is set to be within a range from the output voltage Vo (normal value) +0.5V to the output voltage Vo (normal value) +0.7V.

That is, the predetermined value is set to be higher than the output voltage Vo under normal operating conditions, and to be lower than the value at which a current begins to flow from the collector to the base of the power transistor 11. Under normal operating conditions, the output voltage Vo is lower than the predetermined value, and the switch driving circuit 16 outputs a signal for conducting the compensating resistance switch SW1. While, when the output voltage Vo is higher than the predetermined value, the switch driving circuit 16 outputs a controlling signal which makes the compensating resistance switch SW1 nonconductive.

Thus, the output voltage detecting circuit 15 and the switch driving circuit 16 detect the voltage of the output terminal OUT of the series regulator 1 under normal operating conditions, and conduct the compensating resistance switch SW1. While, when the voltage is higher than the output voltage Vo under normal operating conditions and higher than the predetermined value set to be lower than the value at which a current begins to flow from the collector to the base of the power transistor 11, the output voltage detecting circuit 15 and the switch driving circuit 16 include compensating resistance switch controlling means which makes the compensating resistance switch SW1 nonconductive.

In this way, the compensating resistance switch SW1 is conducted by the compensating resistance switch controlling means, and the high-temperature-leak compensating resistance REB becomes ready to function under normal operating conditions. While, in a case where the voltage of the output terminal OUT becomes higher than the predetermined value due to misconnection etc., the compensating resistance switch SW1 is made nonconductive by the compensating resistance switch controlling means so that a current does not flow to the high-temperature-leak compensating resistance REB.

Thus, even when a voltage of the output terminal OUT is higher than the value at which a current begins to flow from the collector to the base of the power transistor 11, there is no current which flows from the collector via the base of the power transistor 11 to the high-temperature-leak compensating resistance REB. Further, when the voltage of the output terminal OUT is higher than the output voltage Vo under normal operating conditions in FIG. 1, the driving transistor 12 is controlled so as to be OFF.

That is, when the output voltage becomes high, the dropper-type stabilized power circuit suppresses a base current of the power transistor generally. Therefore, under abnormal operating conditions in which the voltage of the output terminal is higher than the input voltage, the base current of the power transistor can be controlled so as not to flow. Thus, under abnormal operating conditions, it is possible to suppresses the current which flows from the collector via the base of the power transistor to paths other than the high-temperature-leak compensating resistance REB. In this way, it is possible to prevent the power transistor from being ON in a reverse direction.

As a result, even when the voltage of the output side is higher than the input voltage with the high-temperature-leak compensating resistance REB provided, it is possible to provide the dropper-type stabilized power circuit which can prevent the reverse current which flows from the output side to the input side.

Figure 2:
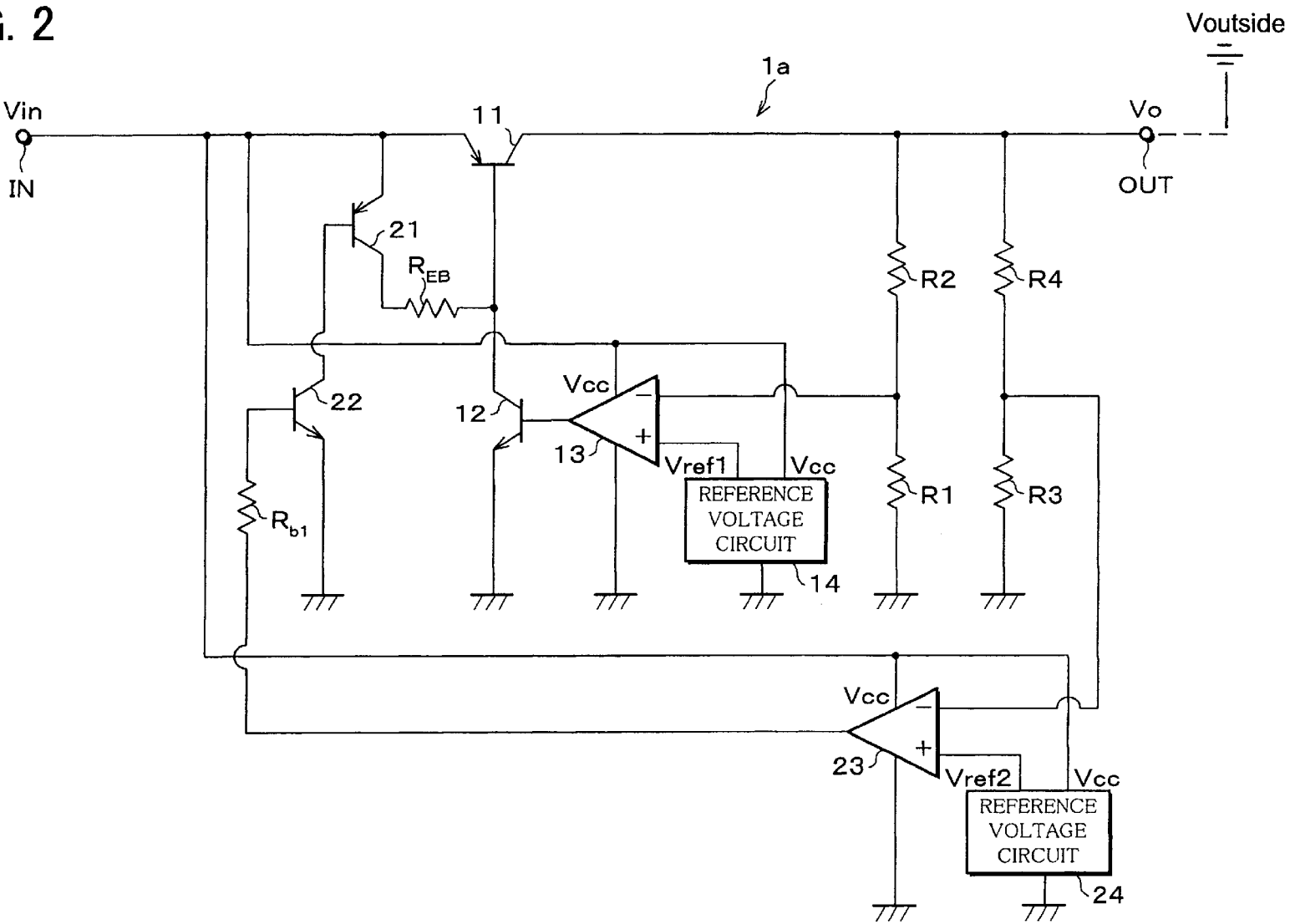
FIG. 2 is a circuit block diagram showing a more specific structure of the stabilized power circuit of FIG. 1.

Next, FIG. 2 shows a concrete example of a structure of the compensating resistance switch SW1, the output voltage detecting circuit 15, and the switch driving circuit 16. In a series regulator 1*a* of FIG. 2, the compensating resistance switch SW1 is realized with a transistor 21, and the output voltage detecting circuit 15 is realized with voltage dividing resistances R3 and R4, and the switch driving circuit 16 is realized with a transistor 22, a resistance $R_{b1}$, a comparator 23, and a reference voltage circuit 24.

The transistor 21 is a PNP-type transistor. An emitter of the transistor 21 is connected to the emitter (input terminal IN) of the power transistor 11, and a collector is connected to an end of the high-temperature-leak compensating resistance REB which is opposite to a connecting point of the base of the power transistor 11. Further, a base of the transistor 21 is connected to a collector of a transistor 22. The transistor 22 is an NPN-type transistor. The collector of the transistor 22 is connected to the base of the transistor 21 as described above, and an emitter is connected to a GND. Further, the base of the transistor 22 is connected to an end of the resistance $R_{b1}$. Another end of the resistance $R_{b1}$ is connected to an output terminal of the comparator 23.

The voltage dividing resistances R3 and R4 are connected in series between the output terminal OUT and the GND. Further, a junction of the voltage dividing resistance R3 and the voltage dividing resistance R4 is connected to an inverting input terminal of the comparator 23.

The reference voltage circuit 24 generates a reference voltage Vref2 corresponding to the predetermined value of the output voltage detecting circuit 15 described above. Further, an output terminal of the reference voltage circuit 24 is connected to a non-inverting input terminal of the comparator 23.

The comparator 23 compares a divided voltage of the output voltage Vo detected by the voltage dividing resistances R3 and R4 with the reference voltage Vref2, and judges whether the output voltage is higher or smaller than the predetermined value, and outputs a signal according to the higher/smaller judgement. Power supply lines to the comparator 23 and the reference voltage circuit 24 are supplied from an input line (input terminal IN) of the power transistor 11.

In the foregoing structure, since the divided voltage of the output voltage Vo detected by the voltage dividing resistances R3 and R4 is lower than the reference voltage Vref2 under normal operating conditions, the comparator 23 judges that the output voltage Vo is lower than the predetermined value, and outputs a signal of "High" level.

By this, the transistor 22 becomes ON, and a base potential of the transistor 21 becomes "Low" level, and the transistor 21 becomes ON. That is, the switch driving circuit 16 outputs a controlling signal of "Low" level to the compensating resistance switch SW1. As a result, the compensating resistance switch SW1 is conducted, so that the high-temperature-leak compensating resistance REB becomes ready to function. On the other hand, when the divided voltage of the output voltage Vo is not less than the reference voltage Vref2, the comparator 23 judges that the output voltage Vo is not less than the predetermined value, and outputs a signal of "Low" level. In this way, the transistor 22 becomes OFF, the base potential of the transistor 21 is made "High" level. Thus, the transistor 21 becomes OFF.

That is, the switch driving circuit 16 outputs a controlling signal of "High" level to the compensating resistance switch SW1. As a result, since the compensating resistance switch SW1 is not conducted, the high-temperature-leak compensating resistance REB is separated from the emitter/base line of the power transistor 11. Thus, it is possible to prevent the reverse current which flows from the output side to the input side of the series regulator la.

Figure 3:
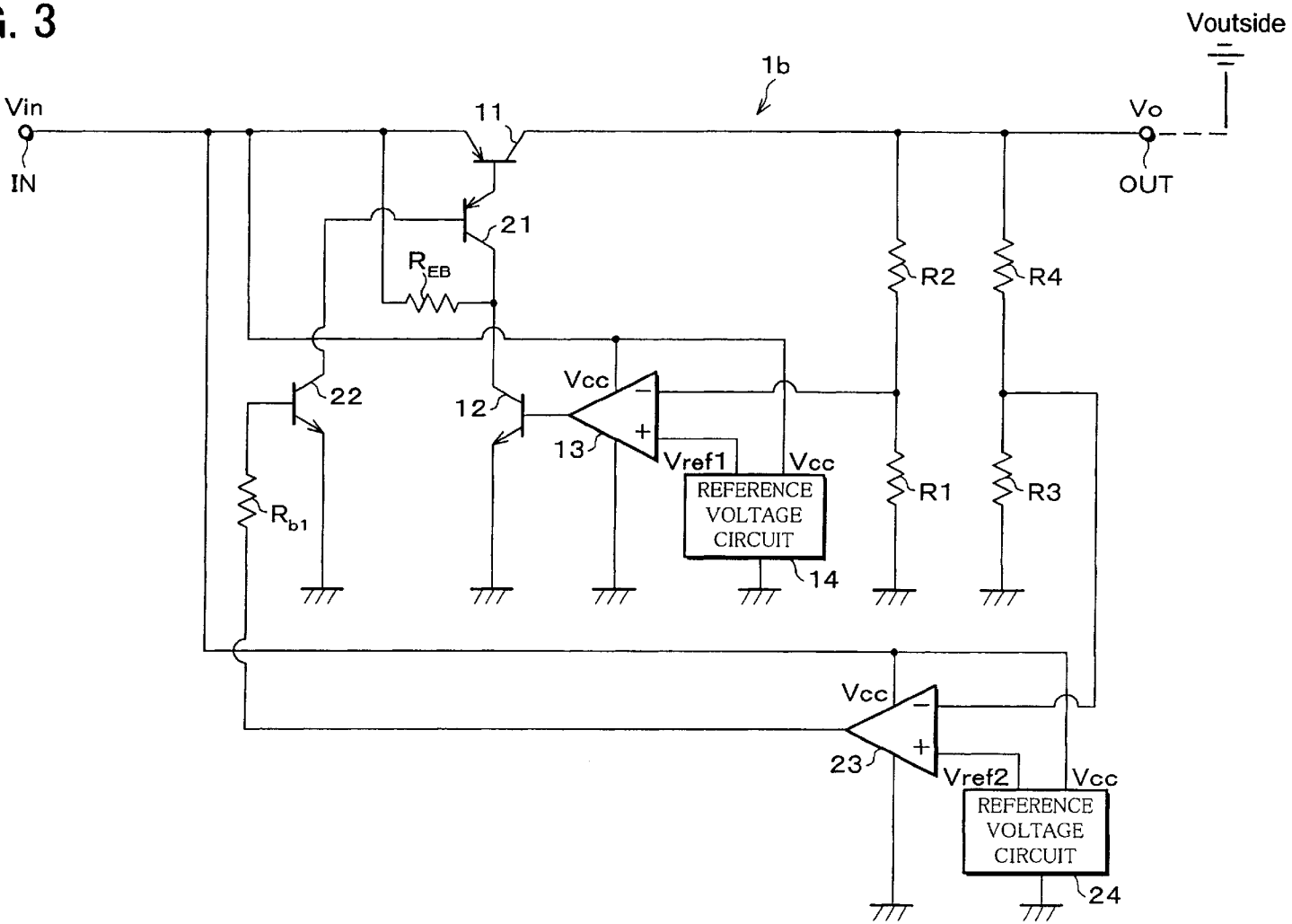
FIG. 3 is a circuit block diagram showing a structure of a modified example of the stabilized power circuit of FIG. 1.

Further, the compensating resistance switch SW1 may be connected like the transistor 21 shown in FIG. 3. In a series regulator 1*b* of FIG. 3, the emitter of the transistor 21 is connected to the base of the power transistor 11, and the collector of the transistor 21 is connected to the collector of the transistor 12. The base of the transistor 21 is connected to the collector of the transistor 22 as in FIG. 2. The high-temperature-leak compensating resistance REB is connected between the emitter of the power transistor 11 and the collector of the transistor 21. Also in this case, the compensating resistance switch SW1 is provided in series with the high-temperature-leak compensating resistance REB between the emitter and the base of the power transistor 11, so that it is possible to prevent the reverse current which flows from the output side to the input side of the series regulator 1*b*.

[Second Embodiment]

Figure 4:
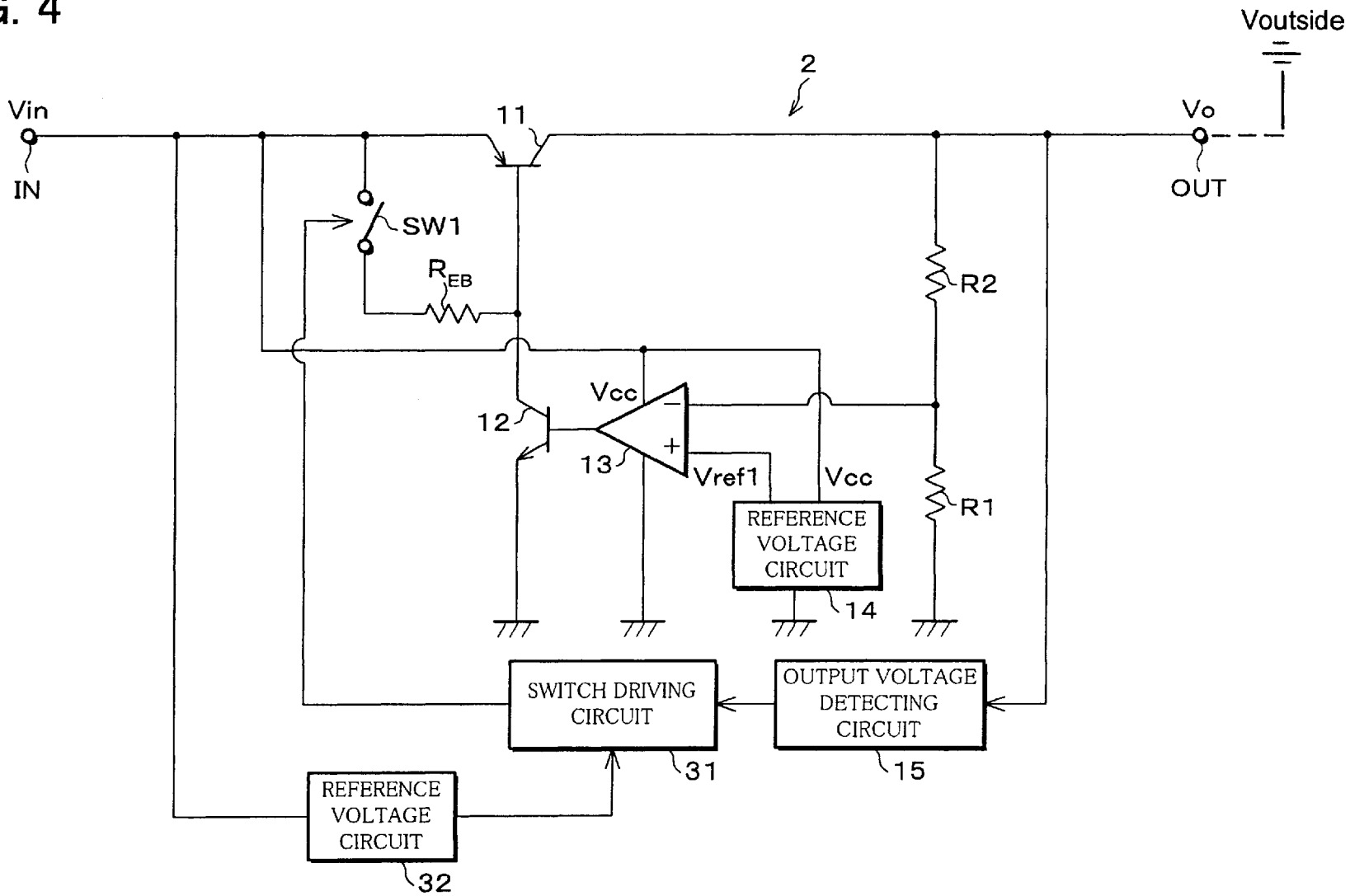
FIG. 4 is a circuit block diagram showing a structure of a stabilized power circuit according to the second embodiment of the present invention.
Figure 5:
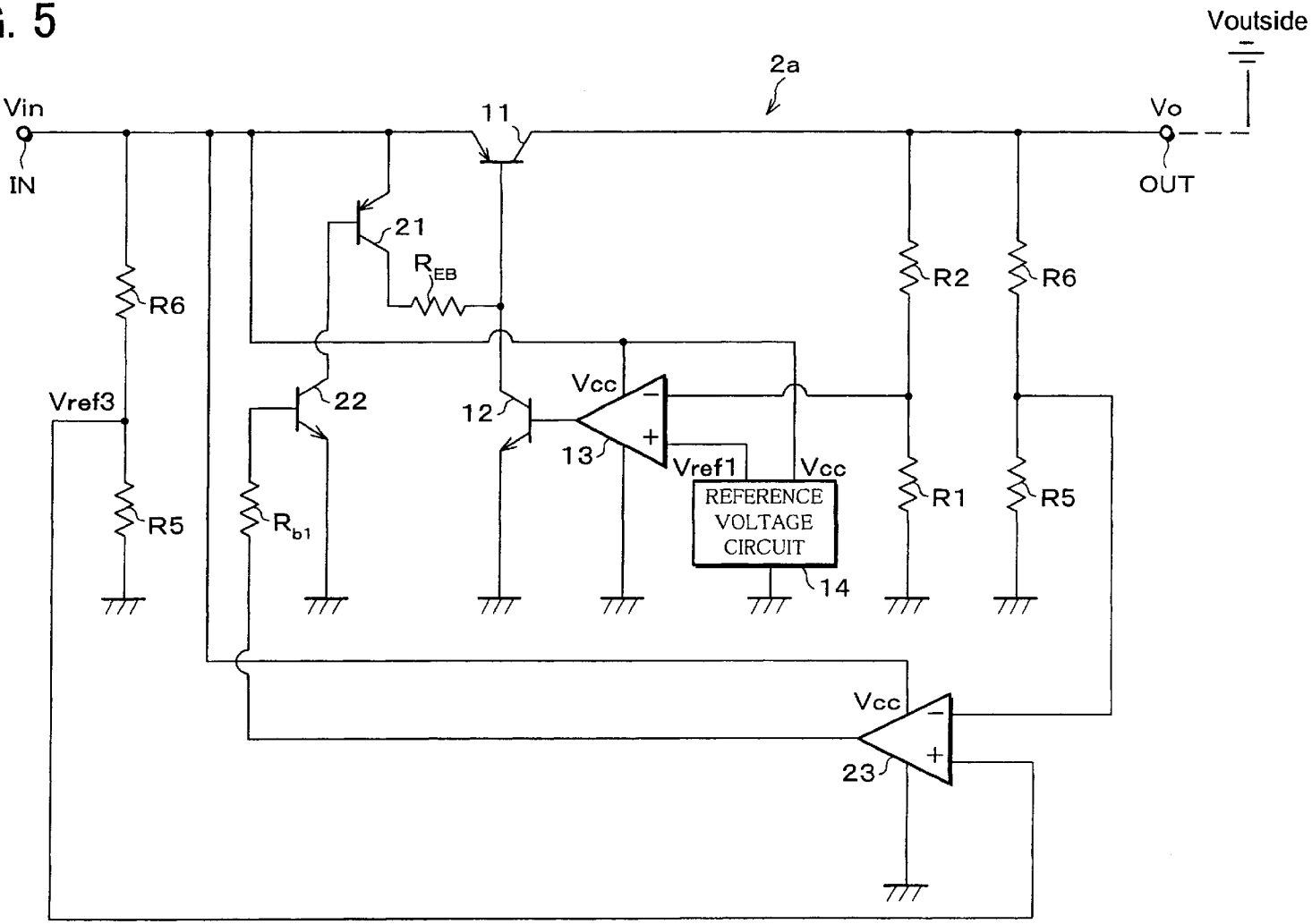
FIG. 5 is a circuit block diagram showing a more specific structure of the stabilized power circuit of FIG. 4.
Figure 6:
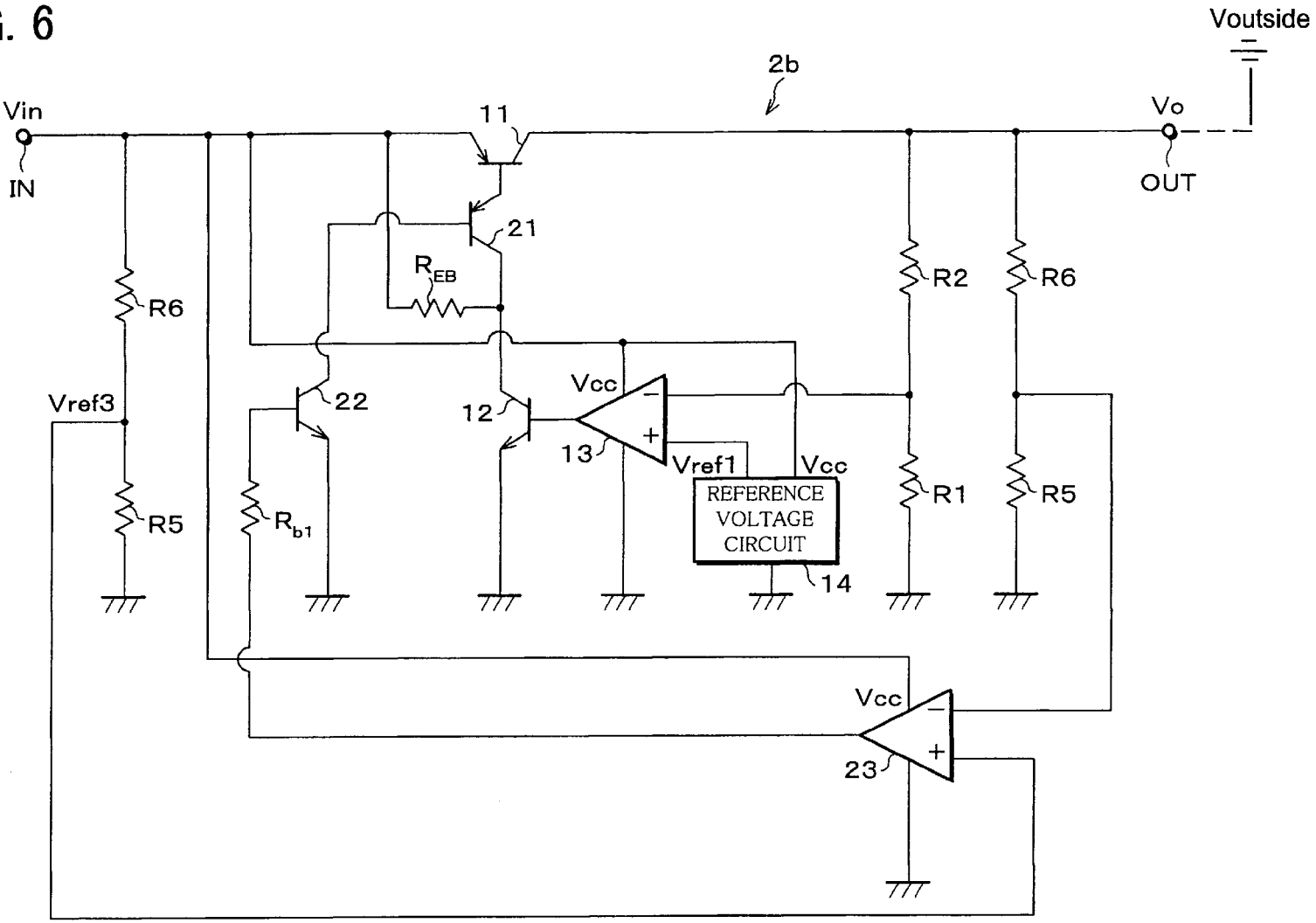
FIG. 6 is a circuit block diagram showing a structure of a modification example of the stabilized power circuit of FIG. 4.

The following description is to describe another embodiment which realizes a stabilized power circuit of the present invention in reference with FIG. 4 to FIG. 6. Note that, components having the same functions as the components described in the first embodiment are given the same reference numerals, and descriptions thereof are omitted.

FIG. 4 shows a structure of a series regulator 2 as a stabilized power circuit according to the present embodiment. The series regulator 2 includes the power transistor 11, the driving transistor 12, the error amplifier 13, the reference voltage circuit 14, an output voltage detecting circuit 15, a switch driving circuit 31, a reference voltage circuit 32, voltage dividing resistances R1 and R2, a high-temperature-leak compensating resistance REB, and a compensating resistance switch SW1.

The reference voltage circuit 32 supplies a voltage corresponding to the input voltage Vin from the input terminal IN of the series regulator 2 to the switch driving circuit 31.

The switch driving circuit 31 determines the input voltage Vin as the predetermined value described in the first embodiment in accordance with a voltage inputted from the reference voltage circuit 32, and compares the input voltage Vin with the output voltage Vo detected by the output voltage detecting circuit 15. According to whether the input voltage Vin is higher or lower than the output voltage Vo, the switch driving circuit 31 outputs a controlling signal which opens or closes the compensating resistance switch SW1. The controlling signal is outputted in the same way as in the first embodiment. That is, the output voltage detecting circuit 15, the switch driving circuit 31, and the reference voltage circuit 32 make up compensating resistance switch controlling means by which a voltage of the output terminal OUT of the series regulator 2 is detected, and the compensating resistance switch SW1 is conducted under normal operating conditions, and when the voltage becomes not less than the predetermined value which is equal to the input voltage Vin, the compensating resistance switch SW1 is not conducted.

As a result, even when the voltage of the output side is higher than the input side with the high-temperature-leak compensating resistance provided, it is possible to provide the dropper-type stabilized power circuit which can prevent the reverse current which flows from the output side to the input side. Further, only when voltage of the output terminal is higher than the input voltage, the compensating resistance switch controlling means does not conduct the compensating resistance switch. Thus, it is easy to judges whether or not the voltage of the output terminal is under abnormal conditions in which the reverse current flows from the output side to the input side.

Next, FIG. 5 shows a concrete example of a structure of the compensating resistance switch SW1, the output voltage detecting circuit 15, the switch driving circuit 31, and the reference voltage circuit 32. In the series regulator 2*a* of FIG. 5, the compensating resistance switch SW1 is realized with the transistor 21, and the output voltage detecting circuit 15 is realized with voltage dividing resistances R5 and R6, and the switch driving circuit 31 is realized with the transistor 22, and the resistance $R_{b1}$, and the comparator 23, and the reference voltage circuit 32 is realized with the voltage dividing resistances R5 and R6 as in the output voltage detecting circuit 15. The transistors 21 and 22, the resistance $R_{b1}$, and the comparator 23 are the same components as in FIG. 2.

The voltage dividing resistances R5 and R6 of the output voltage detecting circuit 15 are provided in series between the output terminal OUT and the GND, and a junction of the voltage dividing resistance R5 and the voltage dividing resistance R6 is connected to the inverting input terminal of the comparator 23.

The voltage dividing resistances R5 and R6 of the reference voltage circuit 32 are provided in series between the input terminal IN and the GND, and a junction of the voltage dividing resistance R5 and the voltage dividing resistance R6 is connected to the not-inverting input terminal of the comparator 23. Thus, in the input voltage to the comparator 23, a voltage ratio of the input voltage Vin and a voltage ratio of the output voltage Vo are equal.

A divided voltage of the input voltage Vin of the reference voltage circuit 32 varies due to changes of the input voltage Vin. However, the output voltage Vo of the voltage detecting circuit 15 which is detected as Vref3 at a certain time is compared with the input voltage Vin, so that whether the input voltage is higher/lower than the output voltage Vo is judged at respective times.

In the foregoing structure, the divided voltage of the output voltage Vo of the output voltage detecting circuit 15 is lower than the reference voltage Vref3 under normal operating conditions. This causes the comparator 23 to judge that the output voltage Vo is lower than the predetermined value (input voltage Vin) and to output a "High" level signal. Thus, the transistor 21 becomes ON state as in the first embodiment. That is, the switch driving circuit 31 outputs a "Low" level controlling signal to the compensating resistance switch SW1. As a result, the compensating resistance switch SW1 is conducted and the high-temperature-leak compensating resistance REB becomes ready to function.

On the other hand, when the divided voltage of the output voltage Vo is higher than the reference voltage Vref 3, the comparator 23 judges that the output voltage Vo is higher than the predetermined value (input voltage Vin), and outputs the "Low" level signal. This causes the transistor 21 to be OFF as in the first embodiment. That is, the switch driving circuit 31 outputs a "High" level controlling signal to the compensating resistance switch SW1. As a result, the compensating resistance switch SW1 is not conducted and the high-temperature-leak compensating resistance REB is separated from the emitter/base line of the power transistor 11. Thus, it is possible to prevent the reverse current which flows from the output side to the input side of the series regulator 2*a*.

Also, the compensating resistance switch SW1 may be provided as in the transistor 21 shown in FIG. 6. In a series regulator 2*b* of FIG. 6, the transistor 21 and the high-temperature-leak compensating resistance REB are provided in the same positioning relation as in the series regulator 1*b* of FIG. 3. In this case, the compensating resistance switch SW1 is provided between the emitter and the base of the power transistor 11 in straight with the high-temperature-leak compensating resistance REB, so that it is possible to prevent the reverse current which flows from the output side to the input side of the series regulator 2*b*.

[Third Embodiment]

The following description is to describe still another embodiment which realizes the stabilized power circuit of the present invention in reference with FIG. 7 to FIG. 10. Note that, components having the same functions as the components described in the first and second embodiments are given the same reference numerals, and descriptions thereof are omitted.

Figure 7:
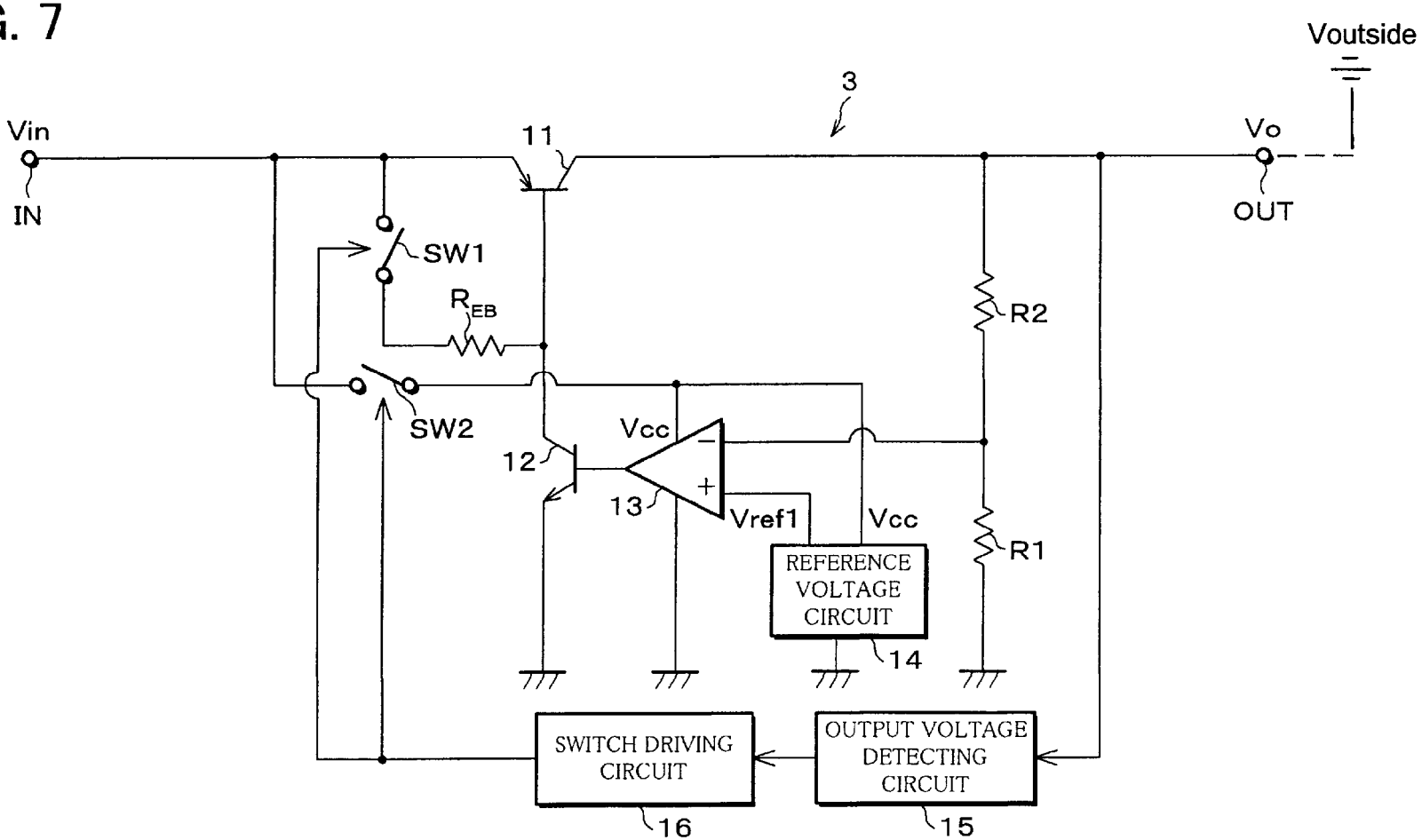
FIG. 7 is a circuit bock diagram showing a structure of a stabilized power circuit according to the third embodiment of the present invention.

FIG. 7 shows a structure of a series regulator 3 as the stabilized power circuit according to the present embodiment. The series regulator 3 includes the power transistor 11, the driving transistor 12, the error amplifier 13, the reference voltage circuit 14, the output voltage detecting circuit 15, the switch driving circuit 16, the voltage dividing resistances R1 and R2, the high-temperature-leak compensating resistance REB, the compensating resistance switch SW1, and a power switch SW2.

The power switch SW2 is inserted in any point of a power supply line supplied from the input side of the power transistor 11 to the error amplifier 13 and the reference voltage circuit 14. Further, this power switch SW2 is conducted or not conducted, based on the output voltage Vo detected by the output voltage detecting circuit 15, by the same controlling signal as the controlling signal which is outputted from the switch driving circuit 16 to the compensating resistance switch SW1.

That is, under normal operating conditions, the power switch SW2 is conducted so that power is supplied to circuits such as the error amplifier 13 and the reference voltage circuit 14 which perform a voltage stabilizing operation, and when the voltage of the output terminal OUT becomes not less than the predetermined value described in the first and second embodiments, the power switch SW2 is not conducted so that power is not supplied to the circuits which perform a voltage stabilizing operation. When the power switch SW2 is not conducted, the error amplifier 13 and the reference voltage circuit 14 stop the voltage stabilizing operation.

Thus, the output voltage detecting circuit 15, the switch driving circuit 16, and the power switch SW2 make up operation stopping means by which when voltage of the output terminal OUT becomes not less than the predetermined value, the voltage stabilizing operation is stopped. By this, when the voltage of the output terminal OUT becomes not less than the predetermined value, an operating current of the circuit which performs a voltage stabilizing operation is reduced. Further, since the voltage of the output terminal OUT is not less than the predetermined value under abnormal operating conditions, the error amplifier 13 and the reference voltage circuit 14 stop the voltage stabilizing operation, so that it is possible to reduce power consumption of the stabilized power circuit without any problem.

Further, the output voltage detecting circuit 15 and the switch driving circuit 16 make up power switch controlling means by which conduction or non-conduction of the power switch SW2 is controlled, and the operation stopping means stops supplying power to the circuit which performs the voltage stabilizing operation and stops the voltage stabilizing operation by including the output voltage detecting circuit 15, the switch driving circuit 16, and the power switch SW2 as described above. Thus, it is possible to restrict the current in the foregoing circuit to a low value such as not more than microampere when the voltage stabilizing operation is stopped. As a result, it is possible to reduce power consumption of the stabilized power circuit greatly.

Further, in the compensating resistance switch controlling means which is made up of the power switch controlling means, the output voltage detecting circuit 15 described in the first and second embodiments, and the switch driving circuit 16, the components may be independent from each other. However, it is preferable that the compensating resistance switch controlling means serves as the power switch controlling means as shown in FIG. 7.

In this case, the compensating resistance switch controlling means which controls conduction or non-conduction of the compensating resistance switch SW1 also controls conduction or non-conduction of the power switch SW2. However, as long as the compensating resistance switch SW1 and the power switch SW2 are switched from conduction to non-conduction in synchronism with each other, it is possible to control conduction or non-conduction of them by using the compensating resistance switch controlling means, that is, by using the same output of the power switch controlling means.

Further, a circuit which detects the voltage of the output terminal OUT can also be controlled by the both switch as in the output voltage detecting circuit 15. Thus, it is possible to simplify a structure of the circuit, and it is not required to take variety of voltage detection of the output terminal OUT into consideration.

Note that, in the output voltage detecting circuit 15 and the switch driving circuit 16 which make up the compensating resistance switch controlling means and the power switch controlling means respectively, for example, the single output voltage detecting circuit 15 may be provided with two switch driving circuits 16 which correspond to the switch for compensating resistance 1 and the power switch 2 provided.

That is, one of the output voltage detecting circuit 15 and the power switch driving circuit 16 is solely provided and the other is pluralized so as to be provided in plural. Thus, it is possible to simplify the structure of the circuit.

Figure 8:
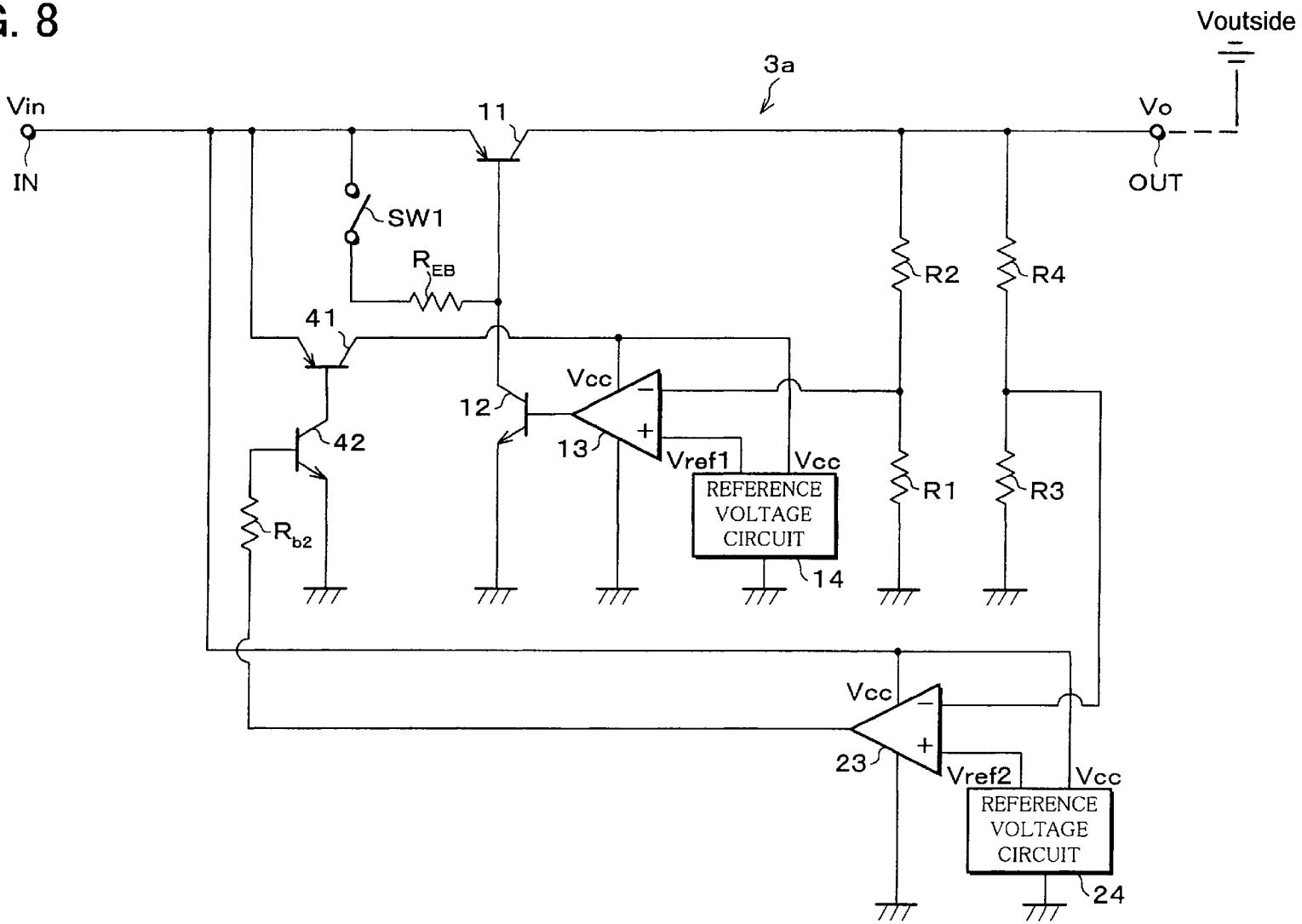
FIG. 8 is a circuit block diagram showing the first structure of the stabilized power circuit which is more specific than FIG. 7.

Next, FIG. 8 shows a concrete example of a structure of the power switch SW2, the output voltage detecting circuit 15, and the switch driving circuit 16. In a series regulator 3*a* of the FIG. 8, the power switch SW2 is realized with a transistor 41, and the output voltage detecting circuit 15 is realized with the voltage dividing resistances R3 and R4, and the switch driving circuit 16 is realized with a transistor 42, the resistance $R_{b2}$, the comparator 23, and the reference voltage circuit 24. The voltage dividing resistances R3 and R4, the comparator 23, and the reference voltage circuit 24 are the same components as in FIG. 2. Further, it is possible to realize the compensating resistance switch SW1 and a circuit supplied from the comparator 23 to the compensating resistance switch SW1 by using the same components of FIG. 2. In these components, the transistor 42 can serve as the transistor 22, and also the resistance $R_{b2}$ can serve as the resistance $R_{b1}$. FIG. 8 is a diagram which shows at least the power switch controlling means.

The transistor 41 is a PNP-type transistor, and an emitter of the transistor 41 is connected to an input line (input terminal IN) of the power transistor 11, and a collector of the transistor 41 is connected to respective power terminals of the error amplifier 13 and the reference voltage circuit 14. Further, a base of the transistor 41 is connected to the collector of the transistor 42.

The transistor 42 is an NPN-type transistor, and the collector is connected to the base of the transistor 41 and the emitter is connected to the GND as described above. Further, the base of the transistor 42 is connected to an end of the resistance $R_{b2}$. Another end of the resistance $R_{b2}$ is connected to the output terminal of the comparator 23.

In the foregoing structure, since the divided voltage of the output voltage Vo detected by the voltage dividing resistances R3 and R4 is lower than the reference voltage Vref2 under normal operating conditions, the comparator 23 judges that the output voltage Vo is lower than the predetermined value, and outputs a "High" level signal. By this, the transistor 42 becomes ON, and makes base potential of the transistor 41 a "Low" level. That is, the switch driving circuit 16 outputs a "Low" level controlling signal to the power switch SW2. As a result, the power switch SW2 is conducted, and power supply to the error amplifier 13 and the reference voltage circuit 14 which has been performed since the rise continues.

Further, at the same time, the compensating resistance switch SW1 is conducted, so that the high-temperature-leak compensating resistance $R_{EB}$ becomes ready to function. While, when the divided voltage of the output voltage is higher than the reference voltage Vref2, the comparator 23 judges that the output voltage Vo is higher than the predetermined value, and outputs a "Low" level signal. This makes the transistor 42 OFF, and the base potential of the transistor 41 becomes "High" level. Then, the transistor 41 becomes OFF. That is, the switch driving circuit 16 outputs a "High" level controlling signal to the power switch SW2. As a result, the power switch SW2 is not conducted, and stop supplying power to the error amplifier 13 and the reference voltage circuit 14. Further, at the same time, the compensating resistance switch SW1 is not conducted, so that the high-temperature-leak compensating resistance $R_{EB}$ is separated from the emitter/base line of the power transistor 11. Thus, it is possible to prevent the reverse current which flows from the output side to the input side of the series regulator 3*a*, and it is possible to reduce the operating current of the error amplifier 13 and the reference voltage circuit 14.

Figure 9:
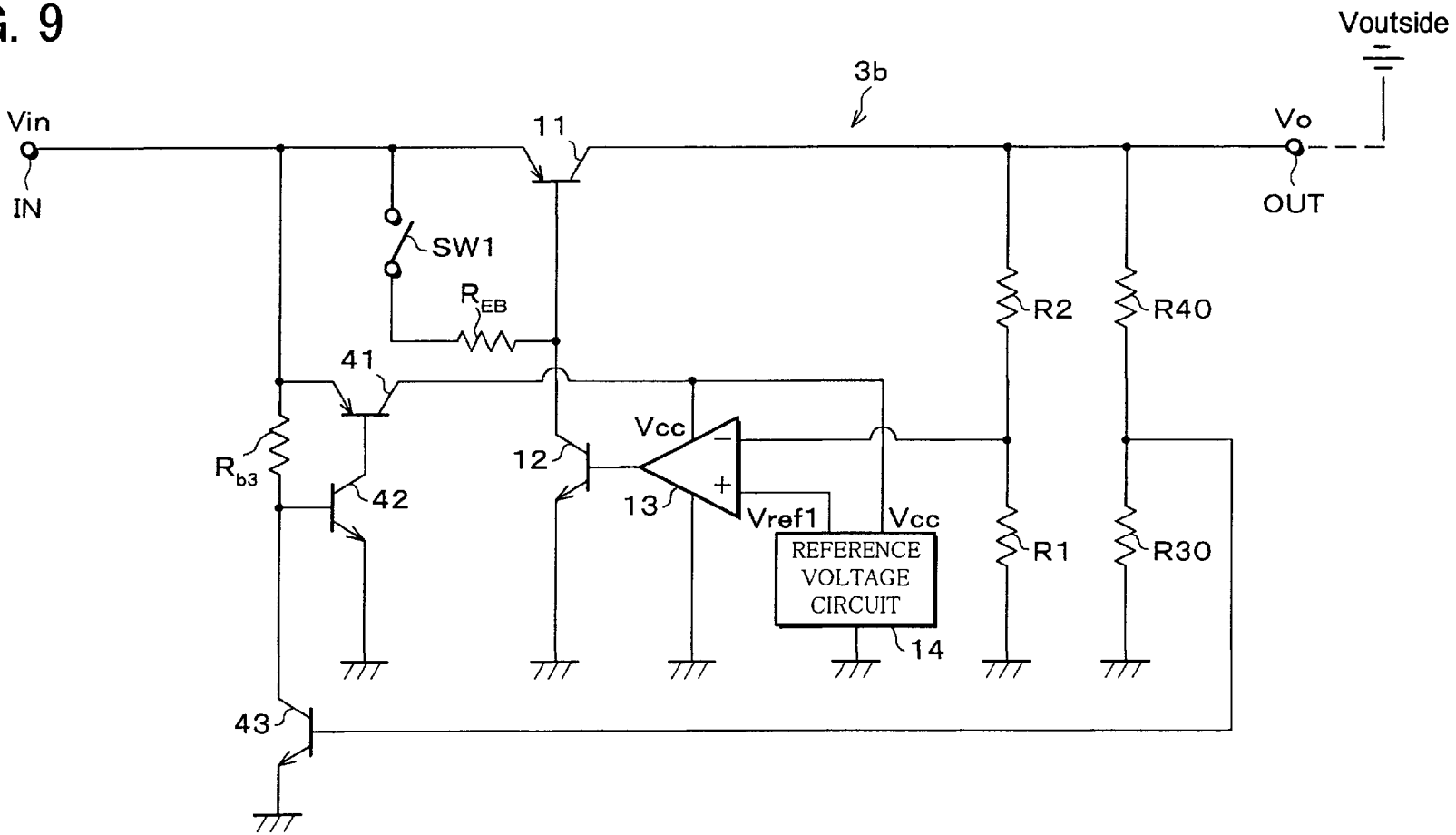
FIG. 9 is a circuit block diagram showing the second structure of the stabilized power circuit which is more specific than FIG. 7.

FIG. 9 shows another concrete example of the structure of the power switch SW2, the output voltage detecting circuit 15, and the switch driving circuit 16. In a series regulator 3*b* of FIG. 9, the power switch SW2 is realized with the transistor 41, and the output voltage detecting circuit 15 is realized with voltage dividing resistances R30 and R40, and the switch driving circuit 16 is realized with the transistors 42, 43, and a resistance $R_{b3}$. The transistors 41 and 42 are the same components as in FIG. 8. Further, the compensating resistance switch SW1 and the compensating resistance switch controlling means can be realized with the same components as in FIG. 2. Further, it is possible that the transistor 21 of FIG. 2 is used as the compensating resistance switch SW1, and a base of the transistor 21 is connected to a base of the transistor 41 of FIG. 9, and the transistor 42 and the resistance $R_{b3}$ are used as the switch for compensating resistance controlling means and the power switch controlling means. FIG. 8 shows at least the compensating resistance switch controlling means.

The voltage dividing resistances R30 and R40 are provided in series between the output terminal OUT and the GND. The transistor 43 is an NPN-type transistor, and the base is connected to a junction of the voltage dividing resistances R30 and R40, and the collector is connected to the base of the transistor 42, and the emitter is connected to the GND.

The resistance Rb3 is provided between the emitter of the transistor 41 and the base of the transistor 42.

Respective resistance values of the voltage dividing resistances R30 and R40 is set so that when the output voltage Vo is equal to the predetermined value, the divided voltage is equal to a threshold value voltage of the base/emitter line of the transistor 43.

In the foregoing structure, the divided voltage of the output voltage detected by the voltage dividing resistances R30 and R40 is lower than the threshold value of the base/emitter line of the transistor 43, so that the transistor 43 becomes OFF. Then, the base potential of the transistor 42 becomes "High" level. This causes the transistor 42 to be ON, so that the base potential of the transistor 41 becomes "Low" level. As a result, the transistor 41 becomes ON. That is, the switch driving circuit 16 outputs a "Low" level controlling signal to the power switch SW2, so that the power switch SW2 is conducted. Thus, supplying power to the error amplifier 13 and the reference voltage circuit 14 which has been performed since the rise continues.

Further, at the same time, the compensating resistance switch SW1 is conducted, so that the high-temperature-leak compensating resistance $R_{EB}$ becomes ready to function. While, when the output voltage Vo becomes not less than the predetermined value, the divided voltage of the output voltage Vo detected by the voltage dividing resistances R30 and R40 becomes not less than the threshold value of the base/emitter of the transistor 43. As a result, the transistor 43 becomes ON, and the base potential of the transistor 42 becomes low level.

This makes the transistor 42 OFF, so that the base potential of the transistor 41 becomes "High" level. As a result, the transistor 41 becomes OFF. That is, the switch driving circuit 16 outputs a "High" level controlling signal to the power switch SW2, and the power switch SW2 is not conducted and stops supplying power to the error amplifier 13 and the reference voltage circuit 14.

Further, at the same time, the compensating resistance switch SW1 is not conducted, so that the high-temperature-leak compensating resistance $R_{EB}$ is separated from the emitter/base line of the power transistor 11. Thus, it is possible to prevent the reverse current which flows from the output side to the input side of the series regulator 3*b*. Moreover, it is possible to reduce the operating current of the error amplifier 13 and the reference voltage circuit 14.

Further, in the present embodiment, the switch driving circuit 16 of FIG. 7 may be replaced with the switch driving circuit 31 and the reference voltage circuit 32 of FIG. 4. In this case, the output voltage detecting circuit 15, the switch driving circuit 31, and the reference voltage circuit 32 make up the compensating resistance switch controlling means, and also make up the power switch controlling means.

Figure 10:
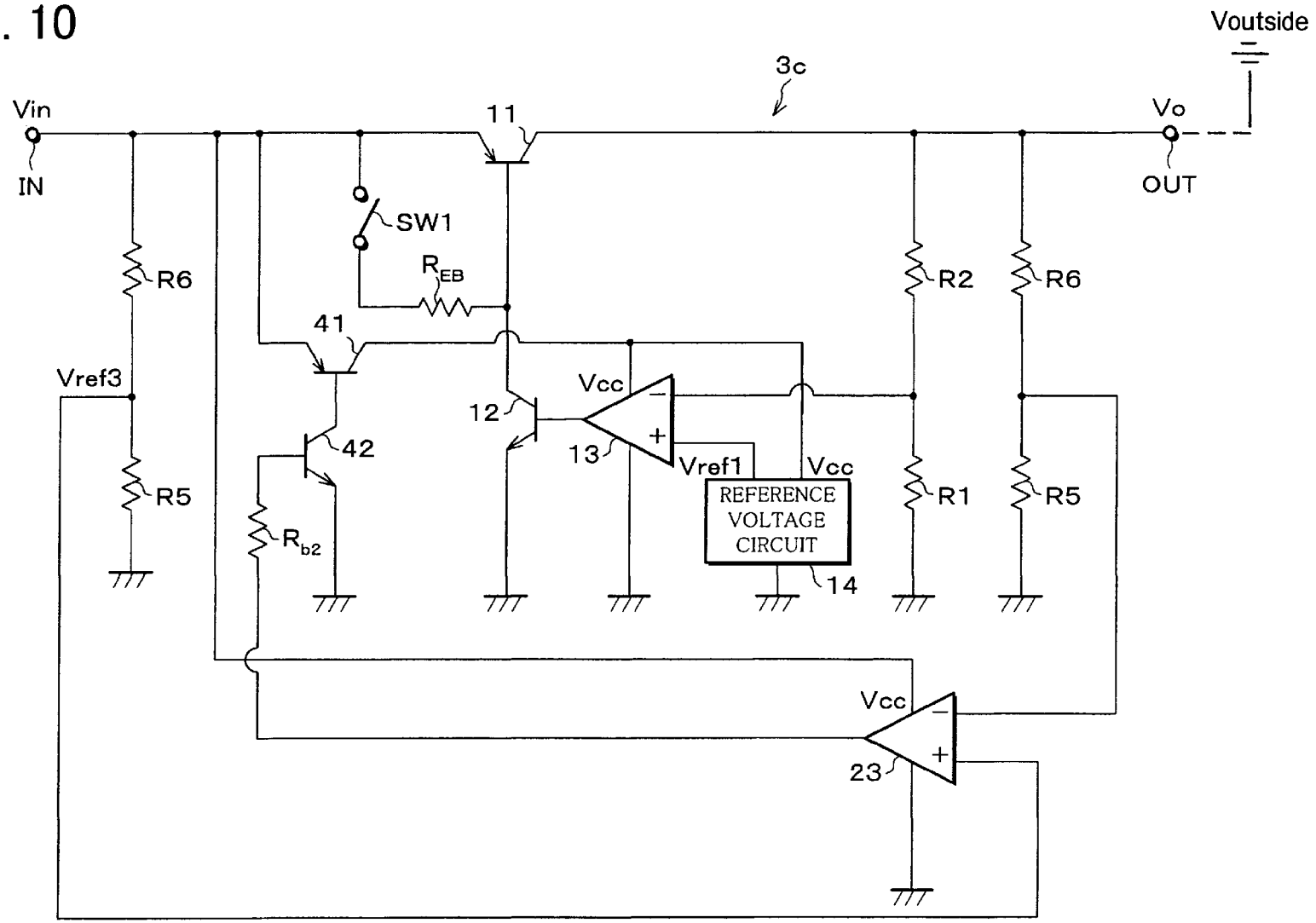
FIG. 10 is a circuit block diagram showing the third structure of the stabilized power circuit which is more specific than FIG. 7.

FIG. 10 shows a concrete example of a structure of the power switch SW2, the output voltage detecting circuit 15, a switch driving circuit 31, and a reference voltage circuit 32. In a series regulator 3*c* of FIG. 10, the power switch SW2 is realized with a transistor 41, and the output voltage detecting circuit 15 is realized with the voltage dividing resistances R5 and R6, and the switch driving circuit 31 is realized with the transistor 42, the resistance $R_{b2}$, and the comparator 23, and the reference voltage circuit 32 is realized with the voltage dividing resistances R5 and R6 as in the output voltage detecting circuit 15. The transistors 41 and 42, the resistance $R_{b2}$, and the comparator 23 are the same components as in FIG. 8, and the voltage dividing resistances R5 and R6 are the same components as in FIG. 5. Further, the compensating resistance switch SW1 and a circuit supplied from the comparator 23 to the compensating resistance switch SW1 are the same positioning relation as in FIG. 8.

In the structure, the divided voltage of the output voltage Vo of the output voltage detecting circuit 15 is lower than the reference voltage Vref3, so that the comparator 23 judges that the output voltage Vo is lower than the predetermined value (input voltage Vin) and outputs a "High" level signal. This makes the transistor 41 become ON as in FIG. 8. While, when the divided voltage of the output voltage Vo is higher than the reference voltage Vref3, the comparator 23 judges that the output voltage Vo is higher than the predetermined value (input voltage Vin) and outputs a "Low" level signal. This makes the transistor 41 become OFF as in FIG. 8.

[Fourth Embodiment]

Figure 11:
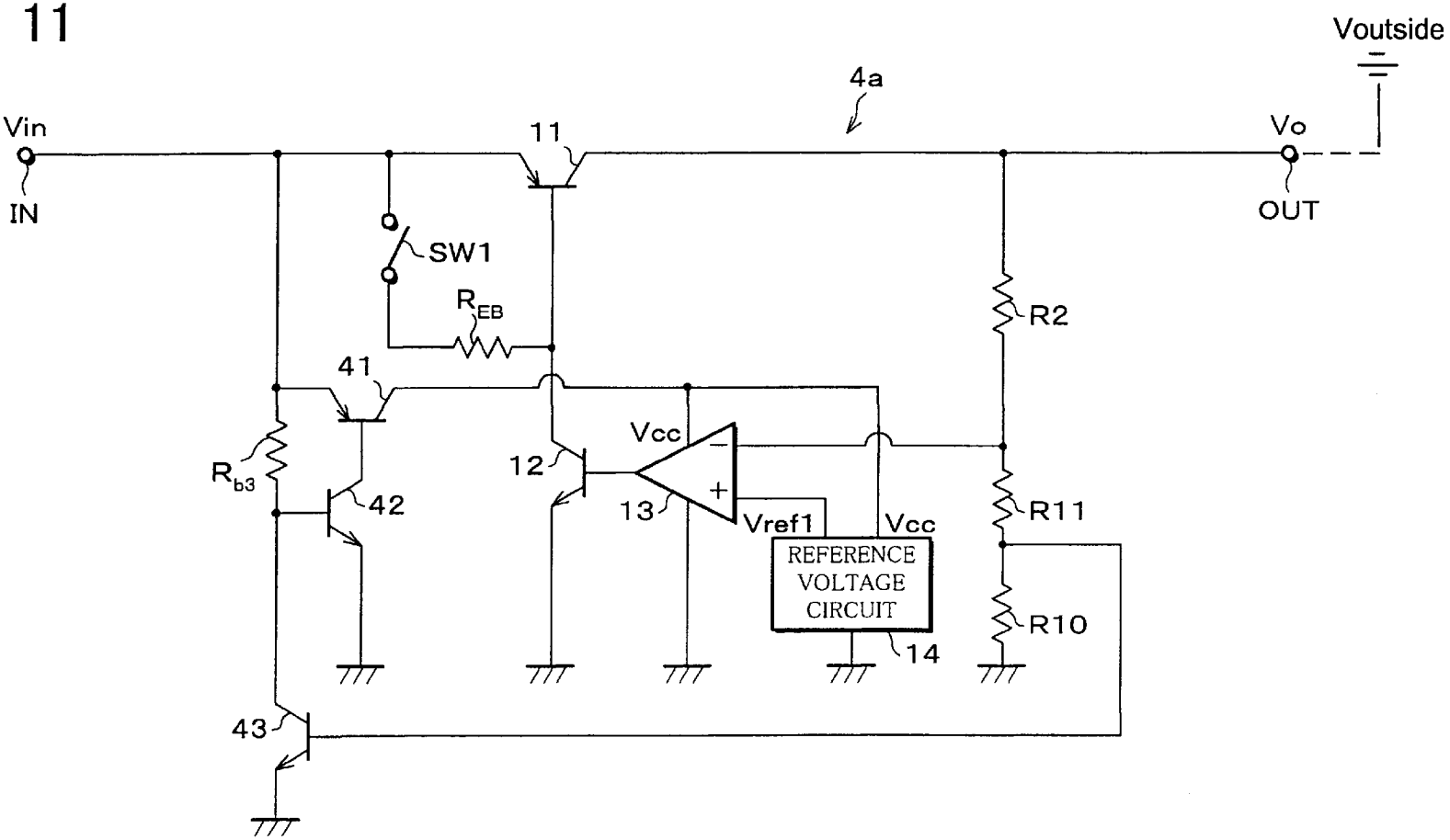
FIG. 11 is a circuit block diagram showing the first structure of a stabilized power circuit according to the fourth embodiment of the present invention.
Figure 12:
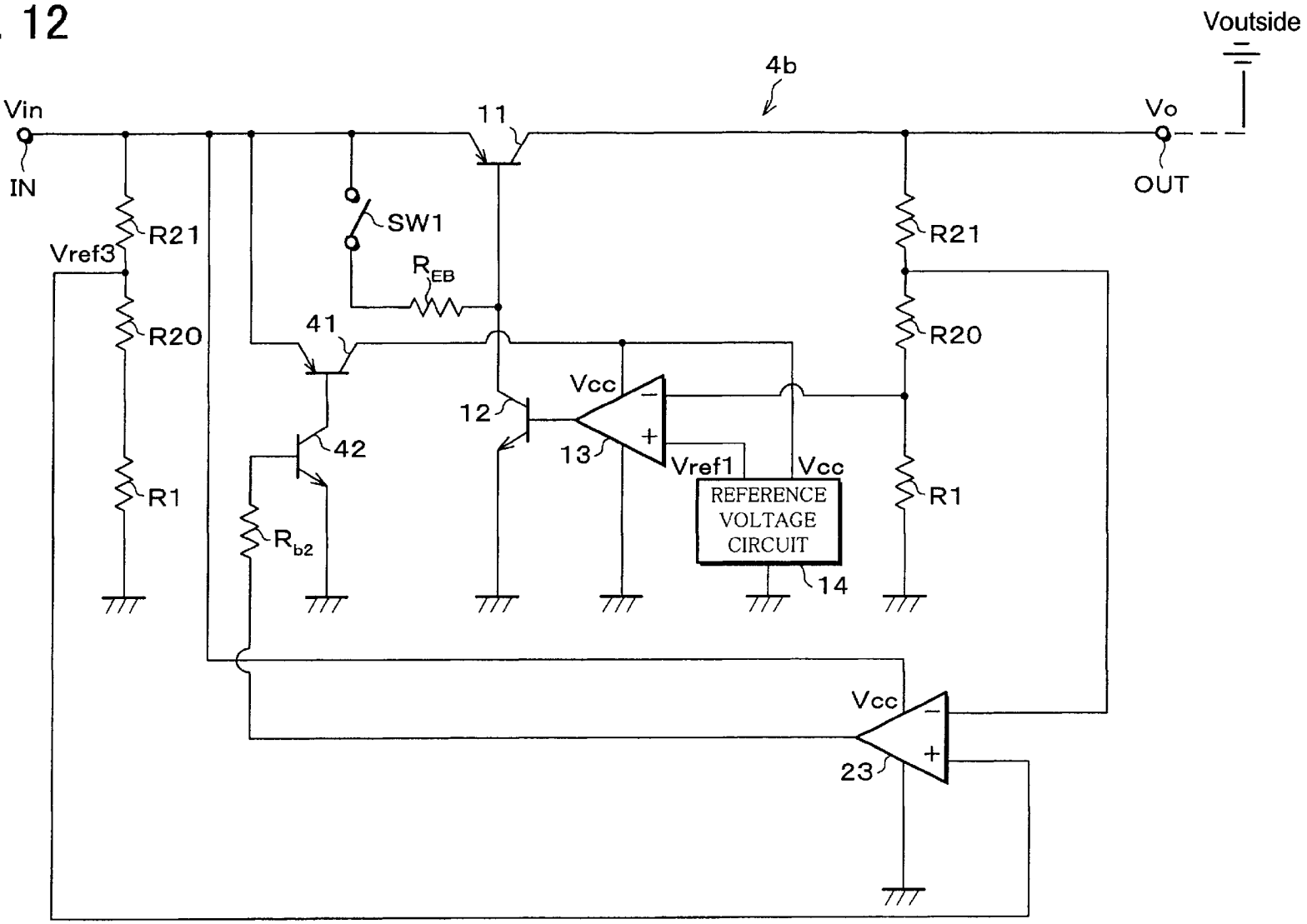
FIG. 12 is a circuit block diagram showing the second structure of the stabilized power circuit according to the fourth embodiment of the present invention.

The following description is to describe still another embodiment which realizes a stabilized power circuit of the present invention in reference with FIG. 11 and FIG. 12. Note that, components having the same functions as the components described in the first to third embodiments are given the same reference numerals, and descriptions thereof are omitted.

FIG. 11 shows a structure of a series regulator 4*a* as a stabilized power circuit according to the present embodiment. The series regulator 4*a* is deferent from the series regulator 3*b* of FIG. 9 in that the voltage dividing resistances R1 and R2 are replaced with the voltage dividing resistances R10, R11, and R2, and the voltage dividing resistances R10, R11, and R2 function as the voltage dividing resistances R30 and R40.

The voltage dividing resistances R10, R11, and R2 are provided in series between the output terminal OUT and the GND. A junction of the voltage dividing resistance R11 and the voltage dividing resistance R2 is connected to the inverting input terminal of the error amplifier 13. A junction of the voltage dividing resistance R10 and the voltage dividing resistance R11 is connected to the base of the transistor 43. Resistance values of the voltage dividing resistances R1, R2, R10, R11, R30, and R40 are r1, r2, r10, r11, r30, and r40 respectively. Between these resistance values, there exists the following relation. r1=r10+r11, r10/(r10+r11+r2)=r30/(r30+r40).

That is, in the series regulator 4*a*, the voltage dividing resistances R10, R11, and R2 for output voltage feedback serve as the output voltage detecting circuit 15 of FIG. 7, and the compensating resistance switch controlling means and the power switch controlling means detect the voltage of the output terminal OUT by using the voltage dividing resistances R10, R11, and R2. Thus, it is possible to reduce the number of elements provided as voltage dividing circuits between the output terminal OUT and the GND, for example, it is possible to reduce the number from two in FIG. 9 to one in FIG. 11.

Further, FIG. 12 shows a structure of a series regulator 4*b* as a stabilized power circuit according to the present embodiment. The series regulator 4*b* is deferent from the series regulator 3*c* of FIG. 10 in that two pairs of the voltage dividing resistances R5 and R6 are replaced with the voltage dividing resistances R1, R20, and R21 respectively, and the voltage dividing resistances R1, R20, and R21 have a function of a voltage dividing resistance as the output voltage detecting circuit 15 (FIG. 4) and a function of a voltage dividing resistance for output voltage feedback used for the voltage stabilizing operation.

The circuit for output voltage feedback and the voltage dividing resistances R1, R20, and R21 as the output voltage detecting circuit 15 are provided in series between the output terminal OUT and the GND. A junction of the voltage dividing resistance R20 and the voltage dividing resistance R21 is connected to the inverting input terminal of the error amplifier 13. A junction of the voltage dividing resistance R20 and the voltage dividing resistance R21 is connected to the inverting input terminal of the comparator 23. The voltage dividing resistances R1, R20, and R21 as the reference voltage circuit 32 (FIG. 4) is provided in series between the input terminal IN and the GND. A junction of the voltage dividing resistance R1 and the voltage dividing resistance R20 is connected to the non-inverting input terminal of the comparator 23. Resistance values of the voltage dividing resistances R1, R2, R5, R6, R20, and R21 are r1, r2, r5, r6, r20, and r21 respectively. Between these resistance values, there exists the following relation. r2=r20+r21, (r1+r20)/(r1+r20+r21)=r5/(r5+r6).

Also in this case, it is possible to reduce the number of elements provided as voltage dividing circuits between the output terminal OUT and the GND as in FIG. 11.

Note that, like the example described above, it is possible to apply the structure in which the voltage dividing resistance for the output voltage feedback serves as the output voltage detecting circuit 15 to all the series regulators described above.

[Fifth Embodiment]

Figure 13:
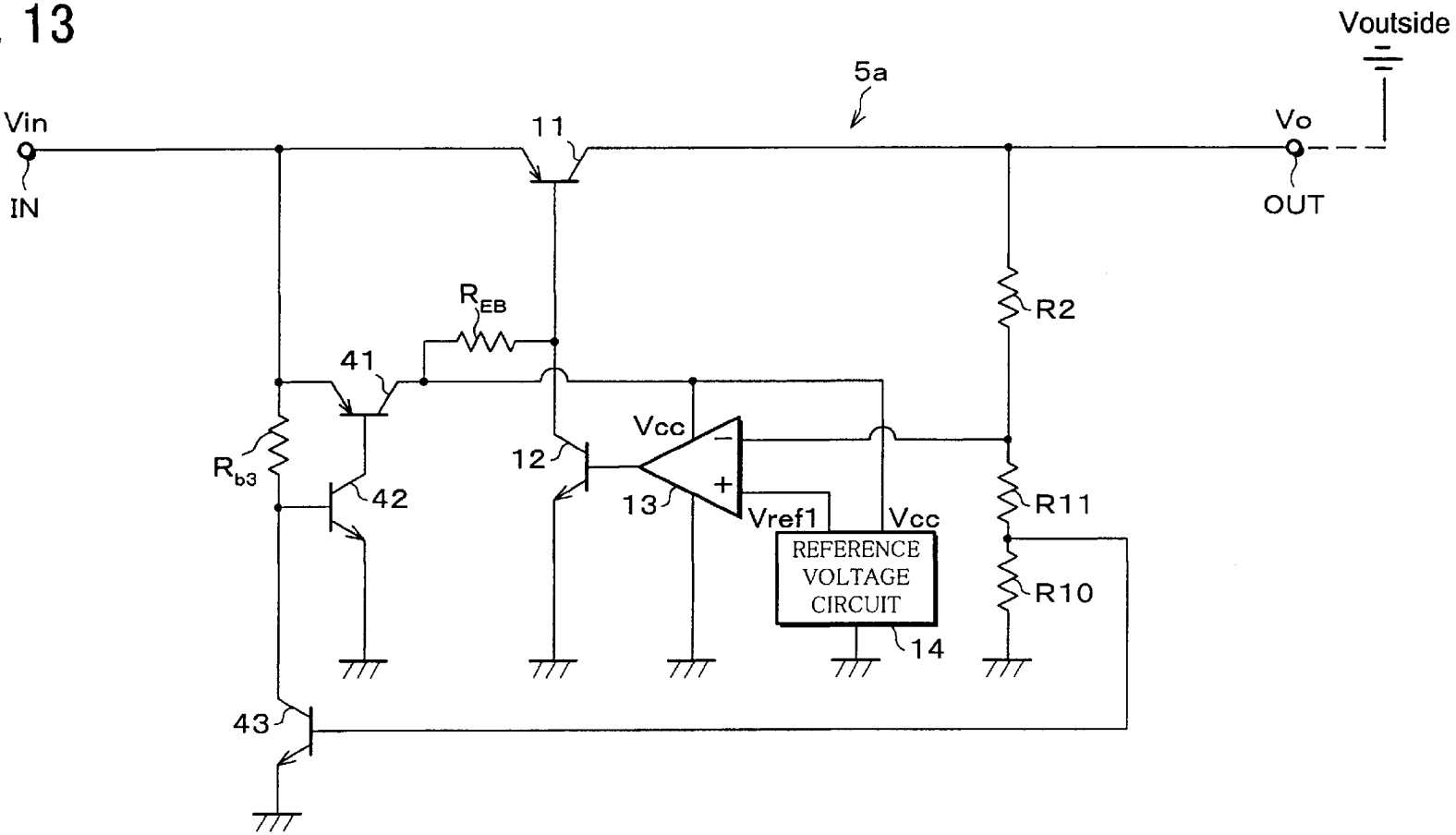
FIG. 13 is a circuit block diagram showing a structure of a stabilized power circuit according to the fifth embodiment of the present invention.

The following description is to describe still another embodiment which realizes a stabilized power circuit of the present invention in reference with FIG. 13. Note that, components having the same functions as the components described in the first to fourth embodiments are given the same reference numerals, and descriptions thereof are omitted.

FIG. 13 shows a structure of a series regulator 5*a* as a stabilized power circuit according to the present embodiment. The series regulator 5*a* is different from the series regulator 4*a* of FIG. 11 in that the high-temperature-leak compensating resistance $R_{EB}$ is provided between the base of the transistor 11 and the collector of the transistor 41, and the compensating resistance switch SW1 is removed.

In this case, the transistor 41 of FIG. 13 functions as a switch which serves as the compensating resistance switch SW1 and the power switch SW2. That is, a power supply line to the circuit which performs a power stabilizing operation is taken from the input side of the power transistor 11 through the path to the high-temperature-leak compensating resistance $R_{EB}$, and the switch serves as the compensating resistance switch SW1 and the power switch SW2 is provided in the path.

As long as the compensating resistance switch SW1 and the power switch SW2 are switched for conduction/non-conduction in synchronism with each other, it is possible to realize this structure. This enables the circuit structure to be simplified. Moreover, it is not required to consider a timing gap of operation which occurs between the compensating resistance switch SW1 and the power switch SW2.

Generally, the switch which serves as the compensating resistance switch SW1 and the power switch SW2 supplies the power supply line to circuits such as the error amplifier 13 and the reference voltage circuit 14 which perform power stabilizing operation from the input side of the power transistor 11. Further, in the structure in which the high-temperature-leak compensating resistance $R_{EB}$ is provided between any point of the power supply line and the base of the power transistor 11, the switch which serves as the compensating resistance switch SW1 and the power switch SW2 is provided between (1) a junction of the power supply line and the high-temperature-leak compensating resistance $R_{EB}$ and (2) a junction of the power supply line and the input line.

[Sixth Embodiment]

Figure 14:
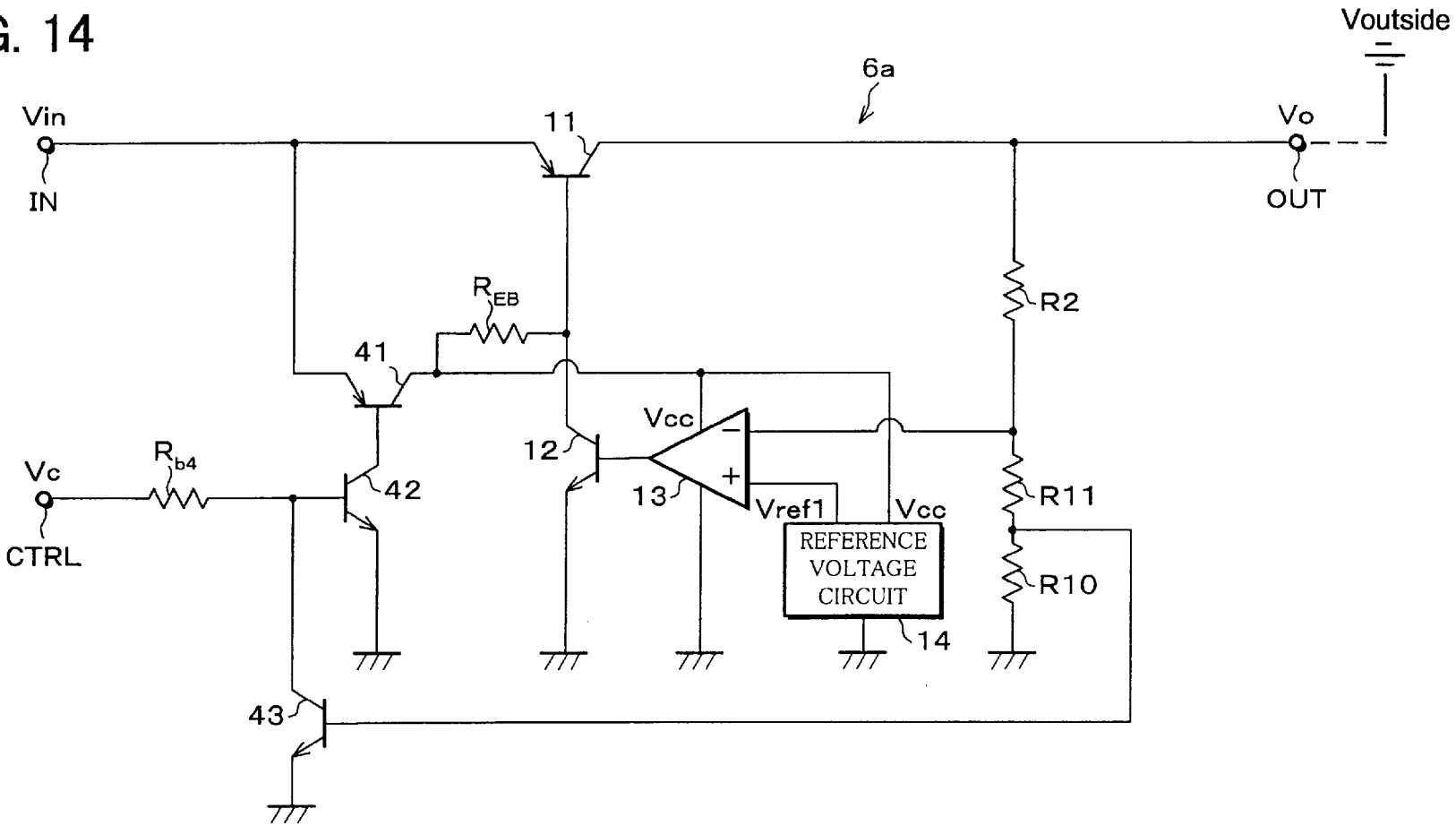
FIG. 14 is a circuit block diagram showing a structure of a stabilized power circuit according to the sixth embodiment of the present invention.
Figure 15:
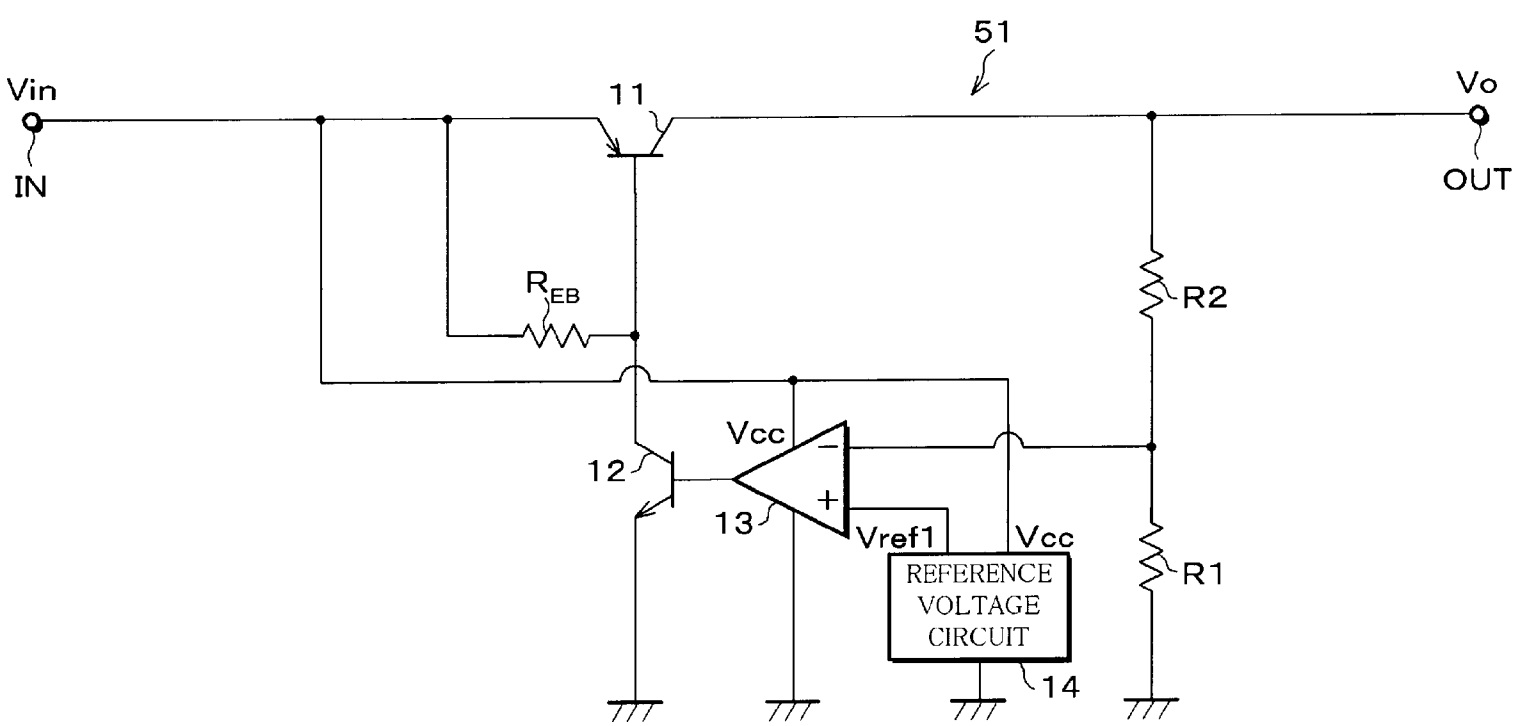
FIG. 15 PRIOR ART
FIG. 15 is a circuit block diagram showing a structure of a conventional stabilized power circuit.

The following description is to describe still another embodiment which realizes a stabilized power circuit of the present invention in reference with FIG. 14. Note that, components having the same functions as the components described in the first to fifth embodiments are given the same reference numerals, and descriptions thereof are omitted.

FIG. 14 shows a structure of a series regulator 6*a* as a stabilized power circuit according to the present embodiment. The series regulator 6*a* is different from the series regulator 5*a* of FIG. 13 in that the resistance $R_{b3}$ is removed, and the emitter of the transistor 41 is separated from the base of the transistor 42, and a terminal CTRL is connected via the resistance $R_{b4}$ to the base of the transistor 42. The terminal CTRL is a terminal which externally receives an operation signal Vc which operates the operation stopping means including the transistors 42 and 43, and the voltage dividing resistances R10, R11, and R2.

Under normal operating conditions, the base potential of the transistor 43 is "Low" and becomes OFF, and a "High" level voltage as an operation signal Vc is given to the terminal CTRL. As a result, the transistor 42 and the transistor 41 become ON.

When the "High" level voltage is applied to the terminal CTRL, a resistance value of the resistance $R_{b4}$ is set so that a voltage of the base/emitter of the transistor 42 is higher than threshold value. When the output voltage is higher than the predetermined value, the transistor 43 becomes ON, so that the base potential of the transistor 42 becomes "Low" level. As a result, the transistor 42 becomes OFF and the transistor 41 becomes OFF. However, the "Low" level voltage as the operation signal Vc is given to the terminal CTRL also under normal operating conditions, so that the transistor 42 becomes OFF and the transistor 41 becomes OFF.

In this way, by providing the terminal CTRL, it is possible to input an appropriate operation signal Vc from the terminal CTRL in a case where the voltage stabilizing operation is to be stopped from outside, including a case where the voltage of the output terminal OUT is abnormal.

Thus, it is not required to additionally provide a circuit for ON/OFF of a normal power supply, so that the circuit can be simplified. However, when the voltage of the output terminal OUT is not less than the predetermined value, it is preferable that the structure is arranged so that the voltage stabilizing operation cannot be performed as in the structure of FIG. 14, even when the operation signal Vc is inputted from the terminal CTRL.

Further, the stabilized power circuit of the present invention which is a dropper-type stabilized power circuit including a PNP-type transistor and a high-temperature-leak compensating resistance provided between an emitter and a base of the power transistor, includes a compensating resistance switch provided in series with the high-temperature-leak compensating resistance between the emitter and the base; and compensating resistance switch controlling means which detects a voltage of the output terminal, and conducts the compensating resistance switch under normal operating conditions in which the output voltage is obtained by dropping an input voltage, and does not conduct the compensating resistance switch when the foregoing voltage is higher than the output voltage under normal operating conditions and higher than a predetermined value which was set to be lower than a value at which a current begins to flow from a collector to the base of the power transistor.

Further, the stabilized power circuit of the present invention can be arranged so that the foregoing predetermined value is equal to the input voltage.

According to the invention, only when the voltage of the output terminal becomes not less than the input voltage, the compensating resistance switch controlling means does not conduct the compensating resistance switch. Thus, it is possible to easily judges that the voltage of the output terminal is under abnormal conditions in which the reverse current flows from the output side to the input side.

Further, the stabilized power circuit of the present invention may be arranged so that the compensating resistance switch controlling means detects the voltage of the output terminal by using the voltage dividing resistance for the output voltage feedback used to perform the voltage stabilizing operation.

According to the present invention, the voltage dividing resistance is used to detects the voltage of the output terminal brought about by the compensating resistance switch controlling means. Thus, it is possible to reduce the number of the elements.

Further, the stabilized power circuit of the present invention can be arranged so as to further include operation stopping means which stops the voltage stabilizing operation when the voltage of the output terminal becomes not less than the predetermined value.

According to the foregoing invention, when a voltage of the output terminal becomes not less than the predetermined value, a reverse current is prevented from flowing from the output side to the input side. Since the operation stopping means stops the voltage stabilizing operation, the operating current of a circuit which performs the voltage stabilizing operation is reduced. Further, since it is under abnormal conditions that a voltage of the output terminal is not less than the predetermined value, it is possible to reduce consumption power of the stabilized power circuit without any problem by stopping the voltage stabilizing operation.

Further, the stabilized power circuit of the present invention can be arranged so as to include a power switch which conducts the operation stopping means so as to supply power to a circuit which performs the voltage stabilizing operation under normal operating conditions, and does not conduct itself when a voltage of the output terminal becomes not less than the predetermined value so as to stop supplying power to the circuit which performs the stabilizing voltage operation, and the power switch controlling means which detects a voltage of the output terminal so as to control conduction or non-conduction of the power switch.

According to the foregoing invention, the power switch and the power switch controlling means are used as the operation stopping means to stop supplying power to circuits such as an error amplifier and its reference voltage circuit which perform the voltage stabilizing operation, so that the voltage stabilizing operation is stopped. Thus, it is possible to restrict current in the circuit to a low value such as not more than microampere when the voltage stabilizing operation is stopped, so that it is possible to reduce consumption power of the stabilized power circuit greatly.

Further, the stabilized power circuit of the present invention can be arranged so that the compensating resistance switch controlling means serves as the power switch controlling means.

According to the foregoing invention, the compensating resistance switch controlling means which controls conduction or non-conduction of the compensating resistance switch also controls conduction or non-conduction of the power switch. As long as the compensating resistance switch and the power switch are switched for conduction/non-conduction in synchronism with each other, it is possible to control by using the same output of the compensating resistance switch controlling means, that is, the same output as the power switch controlling means. Further, it is possible to use a voltage detecting circuit of the output terminal as the both switches at. Thus, the structure of the circuit can be simplified, and it is not required to take variety of voltage detection of the output terminal voltage into consideration.

Further, the stabilized power circuit of the present invention can be arranged so that a power supply line to the circuit which performs the voltage stabilizing operation is taken from the input line of the power transistor, and the high-temperature-leak compensating resistance is provided between any point of the power supply line and the base of the power transistor, and a switch which serves as the compensating resistance switch and the power switch is provided between (1) a junction of the power supply line and the high-temperature-leak compensating resistance and (2) a junction of the power supply line and the input line.

According to the foregoing invention, the power supply line to the circuit which performs the voltage stabilizing operation is taken from the input side of the power transistor and provided in the same path as a path to the high-temperature-leak compensating resistance, and the switch which serves as the compensating resistance switch and the power switch is provided in the path. Thus, the structure of the circuit can be simplified, and it is not required to consider the timing gap which occurs between the both switches.

Further, the stabilized power circuit can be arranged so as to further include a terminal which receives, from outside, an operation signal which operates the operation stopping means.

According to the foregoing invention, in a case where the voltage stabilizing operation is to be stopped from outside, including a case where the voltage of the output terminal is abnormal, it is possible to operates the operation stopping means by inputting the operating signal from the terminal. Thus, it is not required to provide an ON/OFF circuit of a normal power supply, so that the circuit can be simplified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dropper-type stabilized power circuit comprising:

a PNP-type power transistor for obtaining an output voltage at a collector of the power transistor by dropping an input voltage;

a high-temperature-leak compensating resistance provided between an emitter and a base of the power transistor;

a compensating resistance switch provided in series with the high-temperature-leak compensating resistance between the emitter and the base;

an output terminal; and compensating resistance switch controlling means, an input of the compensating resistance switch controlling means detects a voltage at the output terminal, the compensating resistance switch controlling means conducts the compensating resistance switch when a resultant voltage resulting from the detecting resembles the output voltage under normal operating conditions when the input voltage is dropped, and not conducting the compensating resistance switch when the resultant voltage is higher than the output voltage under normal operating conditions and is not less than a predetermined value wherein the predetermined value is set to be not more than a value at which a current begins to flow from the collector to the base of the power transistor.

2. The stabilized power circuit set forth in claim 1 wherein, said compensating resistance switch controlling means includes:

an output voltage detecting circuit which receives the output voltage under normal operating conditions in which the input voltage is dropped so as to obtain the output voltage, and also receives the output voltage when there is an external voltage applied to the output terminal creating a total output voltage, and a switch driving circuit which compares the predetermined value with the resultant voltage from the output voltage detecting circuit so as to output a controlling signal for opening and closing the compensating resistance switch according to a result of the comparison.

3. The stabilized power circuit set forth in claim 2 wherein, said compensating resistance switch includes the PNP-type transistor, said output voltage detecting circuit includes a voltage dividing resistance, and said switch driving circuit includes a reference voltage circuit which generates a reference voltage proportional to the predetermined value, a comparator which compares the reference voltage and the resultant voltage which represents a divided voltage from the voltage dividing resistance so as to judge whether the output voltage is larger or smaller than the reference voltage, a resistance connected to an output terminal of the comparator, and an NPN-type transistor whose base is connected to the resistance.

4. The stabilized power circuit set forth in claim 1 wherein, said compensating resistance switch controlling means detects a voltage at the output terminal, the resultant voltage of the detecting is obtained by a voltage dividing resistance and is variably used for output voltage feedback for a voltage stabilizing operation.

5. The stabilized power circuit set forth in claim 1, further comprising operation stopping means for stopping a voltage stabilizing operation when a voltage of said output terminal becomes not less than the predetermined value.

6. The stabilized power circuit set forth in claim 5 wherein, said operation stopping means includes:

a power switch which conducts itself under normal operating conditions so as to supply power to the circuit which performs the voltage stabilizing operation, and does not conduct itself when a voltage of the output terminal becomes not less than the predetermined value so as to stop supplying power to the circuit which performs a voltage stabilizing operation, and power switch controlling means, which also serves as the compensating resistance switch controlling means, which detects a voltage of the output terminal so as to control conduction/non-conduction of the power switch.

7. The stabilized power circuit set forth in claim 6 wherein, a power supply line to the circuit which performs the voltage stabilizing operation is taken from an input line of the power transistor, and the high-temperature-leak compensating resistance is connected between any point of the power supply line and the base of the power transistor, and the compensating resistance switch and the power switch are a single switch provided between (1) a junction of the power supply line and the high-temperature-leak compensating resistance and (2) a junction of the power supply line and the input line.

8. The stabilized power circuit set forth in claim 6, further comprising a terminal for externally receiving an operation signal which operates said operation stopping means.

9. The stabilized power circuit set forth in claim 1 wherein, the predetermined value is equal to the input voltage.

10. The stabilized power circuit set forth in claim 9, wherein, said compensating resistance switch controlling means detects a voltage at the output terminal, the resultant voltage is obtained by a voltage dividing resistance and is variably used for output voltage feedback for a voltage stabilizing operation.

11. The stabilized power circuit set forth in claim 10 further comprising operation stopping means which stops the voltage stabilizing operation when the voltage of the output terminal becomes not less than the predetermined value.

12. The stabilized power circuit set forth in claim 11, wherein said operation stopping means includes:

a power switch which conducts itself under normal operating conditions so as to supply power to a circuit which performs the voltage stabilizing operation, and does not conduct itself when the voltage of the output terminal becomes not less than the predetermined value so as to stop supplying power to the circuit which performs the voltage stabilizing operation, and power switch controlling means, which also serves as the compensating resistance switch controlling means, which detects the voltage of the output terminal so as to control conduction/non-conduction of the power switch.

13. The stabilized power circuit set forth in claim 12 wherein, a power supply line to the circuit which performs the voltage stabilizing operation is taken from an input line of the power transistor, and the high-temperature-leak compensating resistance is connected between any point of the power supply line and the base of the power transistor, and the compensating resistance switch and the power switch are a single switch provided between (1) a junction of the power Supply line and the high-temperature-leak compensating resistance and (2) a junction of the power supply line and the input line.

14. The stabilized power circuit set forth in claim 12 further comprising a terminal for externally receiving an operation signal which operates said operation stopping means.

15. A stabilized power circuit, comprising:

a power transistor for obtaining an output voltage of an output terminal by dropping an input voltage of an input terminal;

a high-temperature-leak compensating resistance provided between an emitter and a base of the power transistor;

a compensating resistance switch provided in a current path connecting the input terminal, the high-temperature-leak compensating resistance, and the base of the power transistor, ON/OFF of said compensating resistance switch causing the current path to/not to conduct; and compensating resistance switch controlling means for controlling ON/OFF of the compensating resistance switch in accordance with a voltage of the output terminal.

16. The stabilized power circuit as set forth in claim 15, wherein:

the compensating resistance switch controlling means includes:

detecting means for detecting the voltage of the output terminal; and comparing means for comparing the voltage of the output terminal, that has been detected by the detecting means, with a predetermined value corresponding to an output voltage under normal operating conditions, and in said comparing means, when the voltage of the output terminal that has been detected by the detecting means is lower than the predetermined value, the compensating resistance switch is made ON, and when the voltage of the output terminal that has been detected by the detecting means is higher than the predetermined value, the compensating resistance switch is made OFF.

17. The stabilized power circuit as set forth in claim 15, wherein:

the compensating resistance switch controlling means includes:

output voltage detecting means for detecting the voltage of the output terminal;

input voltage detecting means for detecting the voltage of the input terminal; and comparing means for comparing the voltage of the output terminal, that has been detected by the output voltage detecting means, with the voltage of the input terminal, that has been detected by the input voltage detecting means, and in said comparing means, when the voltage of the input terminal is lower than the voltage of the output terminal, the compensating resistance switch is made OFF, and when the voltage of the input terminal is higher than the voltage of the output terminal, the compensating resistance switch is made ON.

18. The stabilized power circuit as set forth in claim 15, wherein the compensating resistance switch controlling means detects the voltage of the output terminal in accordance with a value obtained by a voltage dividing resistance for output voltage feedback used for a voltage stabilizing operation.

19. The stabilized power circuit as set forth in claim 16, further comprising:

operation stopping means for stopping a voltage stabilizing operation when the voltage of the output terminal is higher than the predetermined value.

20. The stabilized power circuit as set forth in claim 17, further comprising:

operation stopping means for stopping a voltage stabilizing operation when the voltage of the output terminal is higher than the voltage of the input terminal.

* * * * *